US007143706B2

(12) United States Patent
Fujihara et al.

(10) Patent No.: US 7,143,706 B2
(45) Date of Patent: Dec. 5, 2006

(54) SEWING MACHINE WITH AUTOMATIC NEEDLE THREADER

(75) Inventors: Shinya Fujihara, Nagoya (JP); Noboru Mizuno, Nagoya (JP); Yoshihisa Shoji, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 30 days.

(21) Appl. No.: 11/169,906

(22) Filed: Jun. 30, 2005

(65) Prior Publication Data

US 2006/0011121 A1 Jan. 19, 2006

(30) Foreign Application Priority Data

Jun. 30, 2004 (JP) ..... 2004-194031

(51) Int. Cl.
*D05B 87/02* (2006.01)

(52) U.S. Cl. ..... 112/225

(58) Field of Classification Search ..... 112/470.01, 112/225, 224, 237, 238, 239, 220
See application file for complete search history.

(56) References Cited

U.S. PATENT DOCUMENTS 503,899 A 8/1893 Carson
2,494,444 A 1/1950 Lyle
2,704,526 A 3/1955 Benink et al.
5,086,719 A * 2/1992 Ogawa ..... 112/225
5,092,257 A * 3/1992 Ogawa ..... 112/225
6,138,594 A 10/2000 Kito

FOREIGN PATENT DOCUMENTS

JP B2-05-059755 8/1993
JP A-11-276753 10/1999

* cited by examiner

*Primary Examiner*—Danny Worrell
(74) *Attorney, Agent, or Firm*—Oliff & Berridge, PLC

(57) ABSTRACT

A sewing machine includes a needle bar holding a sewing needle having an eye hole, a needle threading mechanism including a threading hook passing a needle thread through the eye hole of the sewing needle, a presser bar with a presser foot attached to its lower end, a vertically moving mechanism vertically moving the presser bar, a drive mechanism driving the vertically moving mechanism, a threading operation unit operating the needle threading mechanism, and a drive mechanism controlling unit controlling the drive mechanism vertically moving the presser bar to a position where interference between the presser foot and threading hook is avoided when the needle threading operation unit is operated.

22 Claims, 25 Drawing Sheets

SEWING MACHINE WITH AUTOMATIC NEEDLE THREADER

BACKGROUND OF THE INVENTION

1. Filed of the Invention

The present invention relates to a sewing machine having a needle threading mechanism, which automatically threads a thread eye of a sewing needle.

2. Description of the Related Art

Conventional sewing machines have a plurality of thread passing parts (a thread tension regulator, a thread take-up spring, a thread take-up lever, a needle bar thread guide etc.), through which a needle thread extending from a thread spool is passed. After having been passed through the thread passing parts in a predetermined sequence and path, the needle thread is passed through a thread eye of a sewing needle attached to a needle bar. Also, some of the conventional sewing machines have an automatic needle threader having a thread retaining member and a threading member to retain the end of the needle thread in order to automatically pass the needle thread through the needle eye of the sewing needle. In the above sewing machine, when the needle thread is moved to a thread turnover position near the front of the thread eye of the sewing needle by the thread retaining member retaining the needle thread, the threading member aligned at the same height as the thread eye of the sewing needle rotates in the opposite direction and comes out of the thread eye to pass the needle thread through the needle eye.

On the other hand, sewing machines are provided with a vertically moving mechanism to switch a presser bar having a presser foot to an elevated position and lower position so that the presser foot does not become an impediment when replacing work cloth or adjusting a layout of work cloth. There are two types of vertically moving mechanisms: one of which switches the presser bar to the elevated position and the lowest position depending on user's operation of a presser foot lifting lever and the other, which automatically switches the position of the presser bar.

For example, JP-B-1993-59755 discloses a vertically moving device automatically switching the position of the presser bar. The vertically moving apparatus has two modes, namely, a manual operation mode and an automatic operation mode. In the automatic operation mode, the presser bar is moved to the elevated position predetermined by a servo solenoid. This enables efficient location and rotation of work cloth in a consecutive embroidery process, in which the type of work cloth does not change.

When an automatic threading mechanism is activated in the state, in which the presser bar is in the elevated position, a threading hook member of the automatic threading mechanism and the presser foot interferes with each other and the threading member may be damaged. Therefore, in case of performing needle threading by the threading mechanism in such a state, the user needs to operate a presser foot lifting lever to move the presser bar to the lower position. That is, even in the case of performing needle threading by the automatic threading mechanism, manual operation needs to be performed and it becomes difficult to improve an efficiency of the needle threading process.

Also, the elevating device set forth in the above-noted publication only automatically moves the presser bar to the predetermined elevated position and does not automatically move the presser bar in conjunction with the operation of the automatic threading mechanism. Therefore, in order to operate the automatic threading mechanism when the presser bar is in the elevated position, the user needs to operate the presser foot lifting lever and move the presser bar to the lower position.

SUMMARY OF THE INVENTION

Therefore, an object of the present invention is to provide a sewing machine, which is capable of automatically performing the entire needle threading process by a threading mechanism independent of the location of a presser bar.

The present invention provides a sewing machine comprising a needle bar holding a sewing needle having a thread eye, a needle threading mechanism including a threading hook passing a needle thread through the thread eye of the sewing needle, a presser bar having a lower end to which a presser foot is attached, a vertically moving mechanism vertically moving the presser bar, a drive mechanism driving the vertically moving mechanism, a needle threading operation unit operating the needle threading mechanism, and a drive mechanism controlling unit controlling the drive mechanism vertically moving the presser bar to a position where interference between the presser foot and the threading hook is avoided when the needle threading operation unit is operated.

The invention also provides a sewing machine comprising a needle bar holding a sewing needle having an eye hole, a thread retaining member retaining the needle thread, a thread transferring mechanism constructed to move the thread retaining member near the eye hole of the sewing needle thereby to transfer the needle thread near the eye hole, a presser bar with a presser foot attached to a lower end thereof, a vertically moving mechanism vertically moving the presser bar, a drive mechanism driving the vertically moving mechanism, a thread transferring operation unit operating the thread transferring mechanism, and a drive mechanism controlling unit controlling the drive mechanism so that the presser bar is vertically moved to a position where interference between the presser foot and the thread retaining member is avoided when the thread transferring operation unit has been operated.

According to the above construction, by the user's operation of the threading operation unit, the needle threading process is automatically performed with presser bar vertically moved to the position to avoid the interference between the presser foot and thread retaining member. This enables the entire needle threading process to be performed automatically, not requiring any work on the part of the user.

BRIEF DESCRIPTION OF THE DRAWINGS

Other objects, features and advantages of the present invention will become clear upon reviewing the following description of the embodiments with reference to the accompanying drawings, in which.

DETAINED DESCRIPTION OF THE INVENTION

Figure 1:
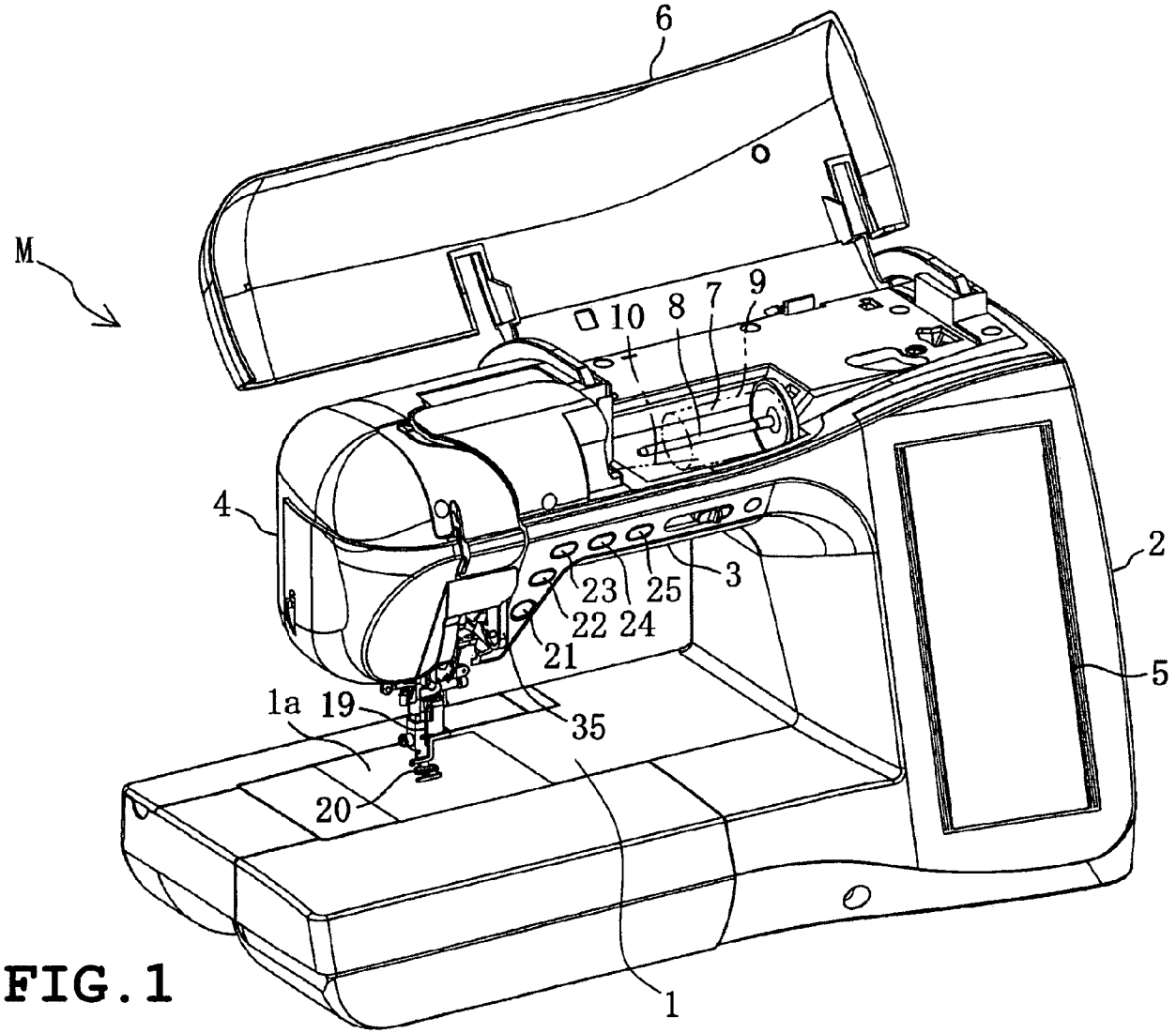
FIG. 1 is a perspective view of a sewing machine involving the first embodiment of the current invention viewed from the upper left.
Figure 2:
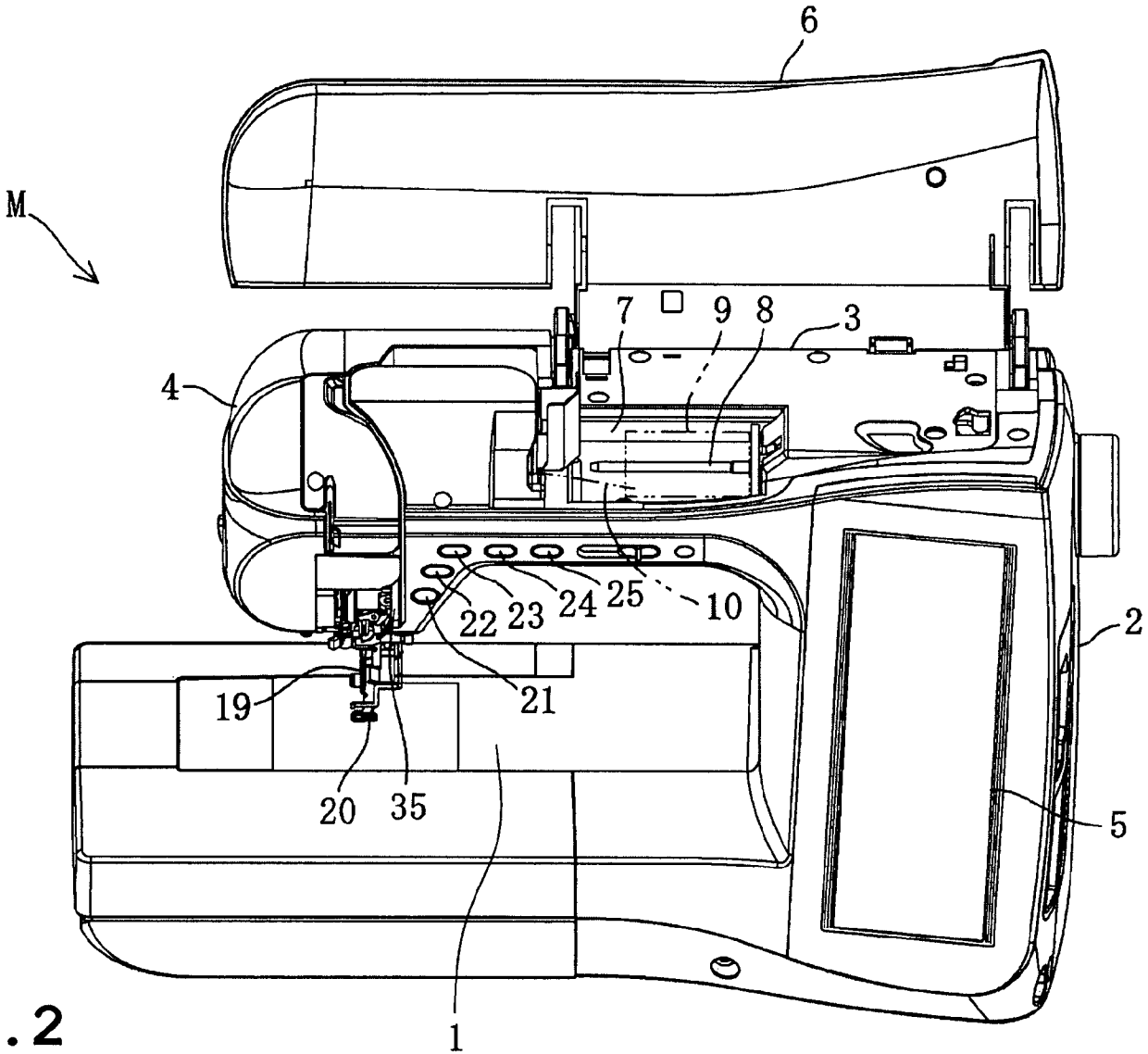
FIG. 2 is a perspective view viewed from the upper front of the sewing machine.
Figure 3:
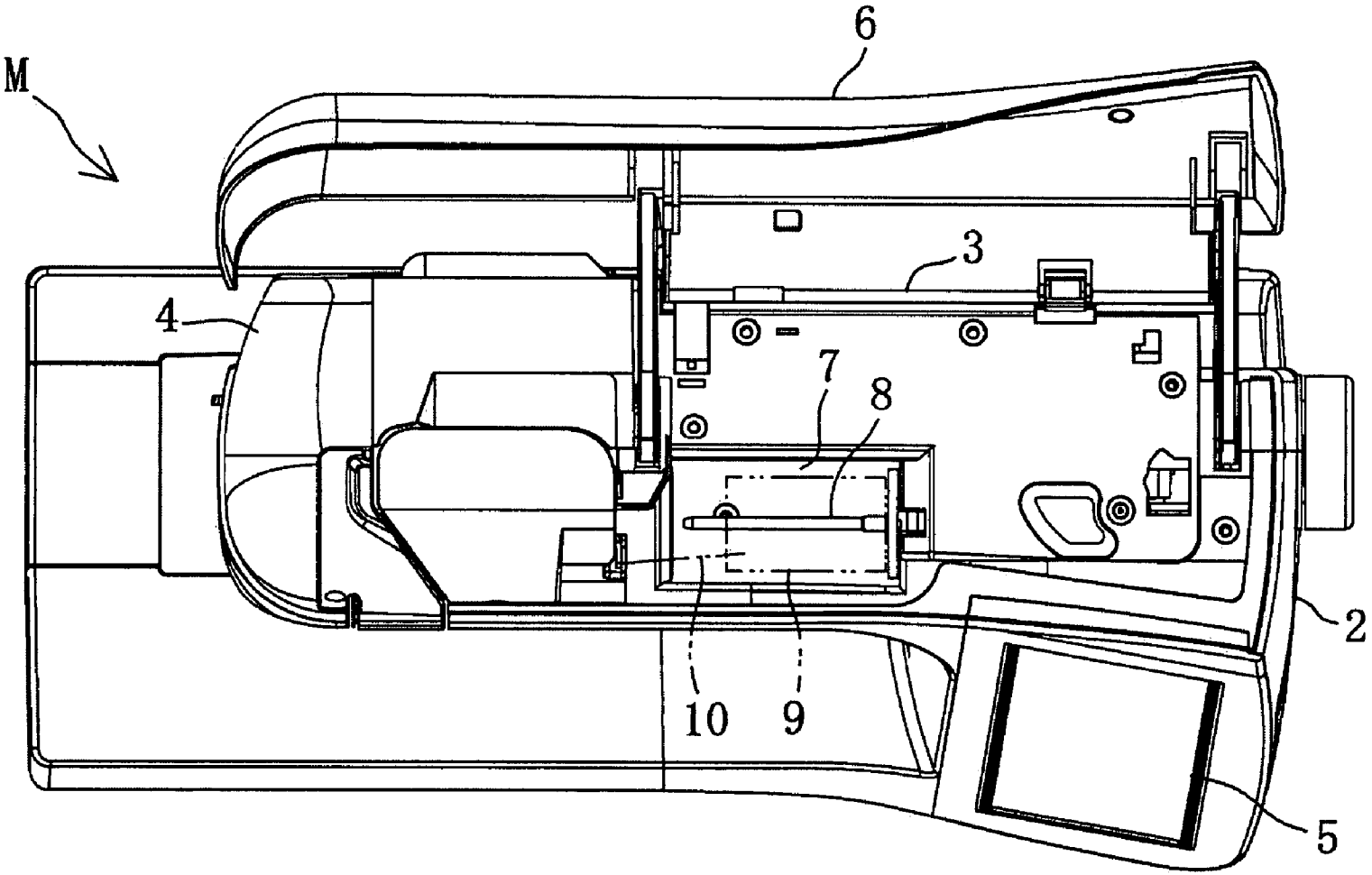
FIG. 3 is a plan view of the sewing machine.

The embodiments of the present invention is explained with reference to the drawings hereinafter. As shown in FIGS. 1–3, a sewing machine M has a sewing bed 1, a sewing pillar 2 provided in the right side of the bed 1, a sewing arm 3 extending from an upper part of the foot to the left converging the bed 1 and a sewing head 4 provided on the left side of the arm 3. The bed 1 is provided with a needle plate 1*a* and among the bed 1 parts, a rotary hook mechanism (not shown) is provided under the needle plate 1*a*. A bobbin on which a bobbin thread is wound is detachably attached to a rotary hook mechanism. On the front surface of the pillar 2, a liquid crystal display 5 is provided. On the front surface of the lower part arm 3, a sewing start switch 21, a sewing end switch 22, an automatic thread hook preparation switch 23, a presser foot moving switch 24, an automatic thread hook start switch 25 (corresponding to a thread operation unit) are provided.

An openable cover 6 is attached on top of the arm 3. The cover 6 is provided entirely across the arm 3 in the left-right direction. The cover 6 is supported openably about the axis extending in the left-right direction on the upper-rear part of the arm.

A thread installing concave 7 is formed on top of the arm located to the right of the head 4. In the thread installing concave a spool pin 8 is arranged to retain a thread spool 9. The thread spool 9 attached to the spool pin 8 is placed side ways in the left-right direction within the thread installing concavity.

Figure 4:
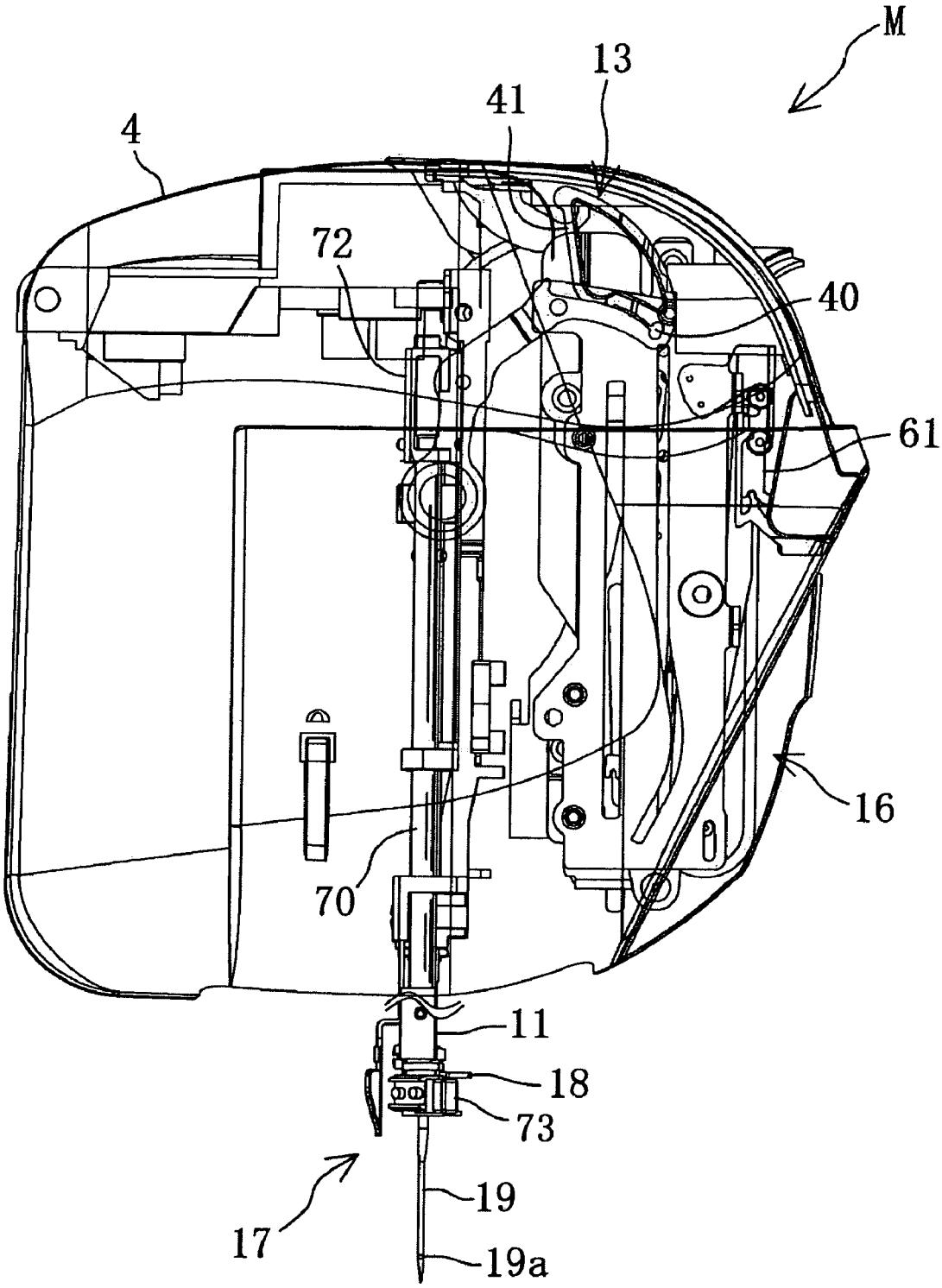
FIG. 4 is a transparent left side view of the sewing machine capable of automatic thread hook.
Figure 5:
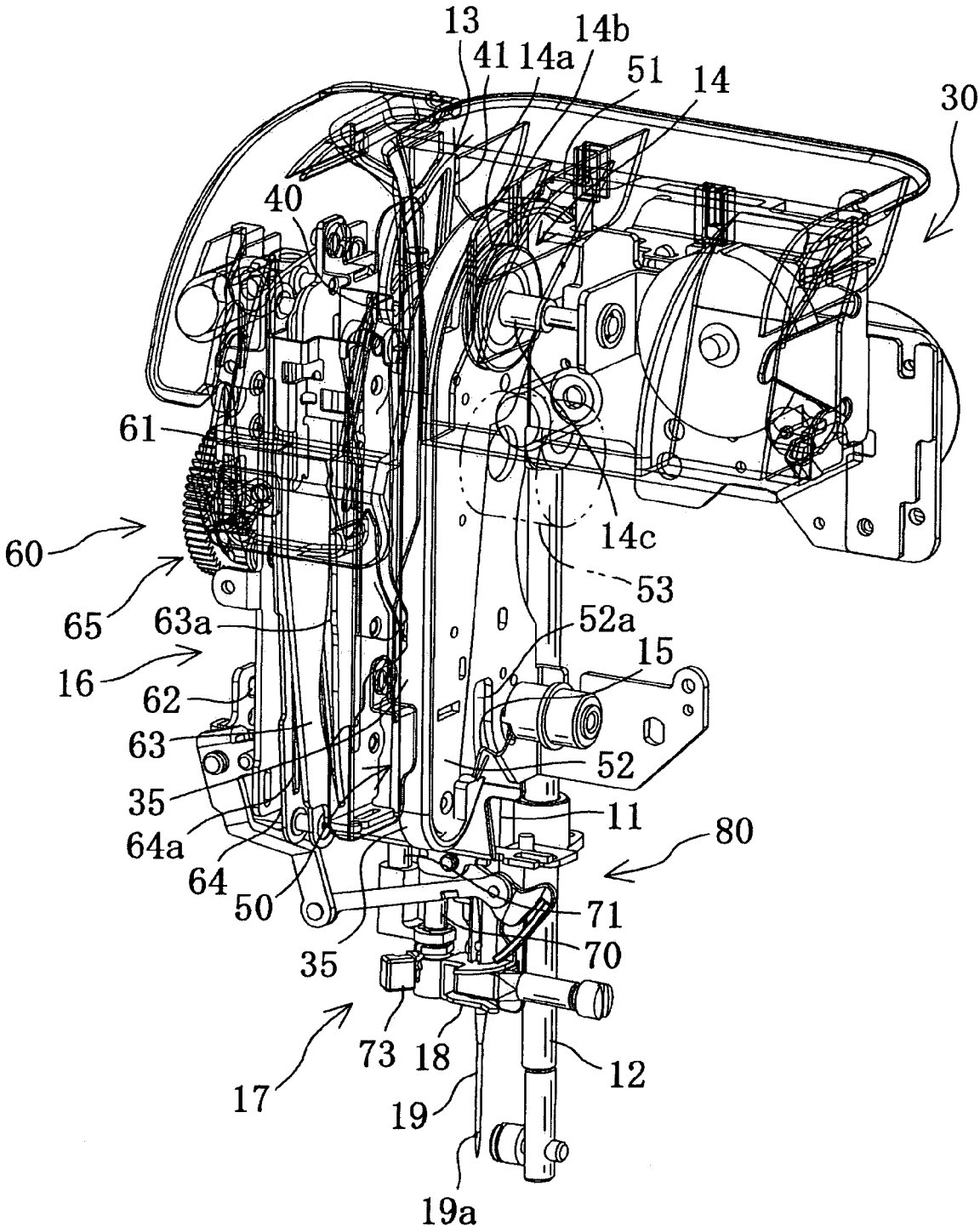
FIG. 5 is a perspective view viewed from the upper right of an automatic threading apparatus and automatic threading mechanism.
Figure 6:
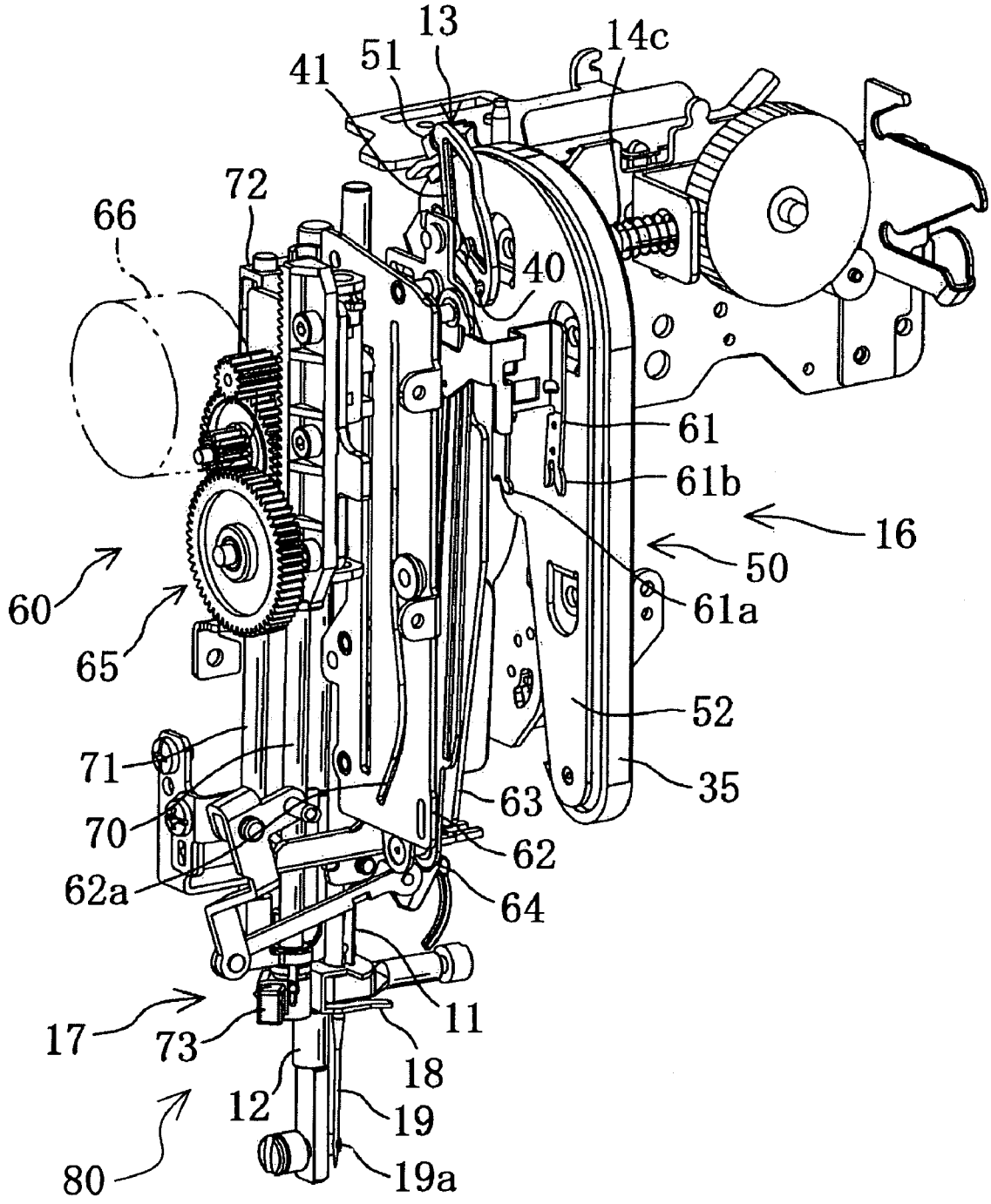
FIG. 6 is a perspective view viewed from the upper left of the automatic threading apparatus and automatic threading mechanism.

As shown in FIGS. 4–6, a needle bar 11, a presser bar 12, a thread take-up lever 13, a thread tension regulator 14, a thread take-up spring 15, an automatic threading device 16, and an automatic needle threading mechanism 17 etc. are provided. The needle bar 11 is supported vertically movably on a sewing machine frame and on the lower end of the needle bar a needle bar thread guide 18 is provided while the sewing needle 19 is supported thereon. The sewing machine drive mechanism (not shown) having a sewing machine motor 27 drives the needle bar 11.

Figure 9:
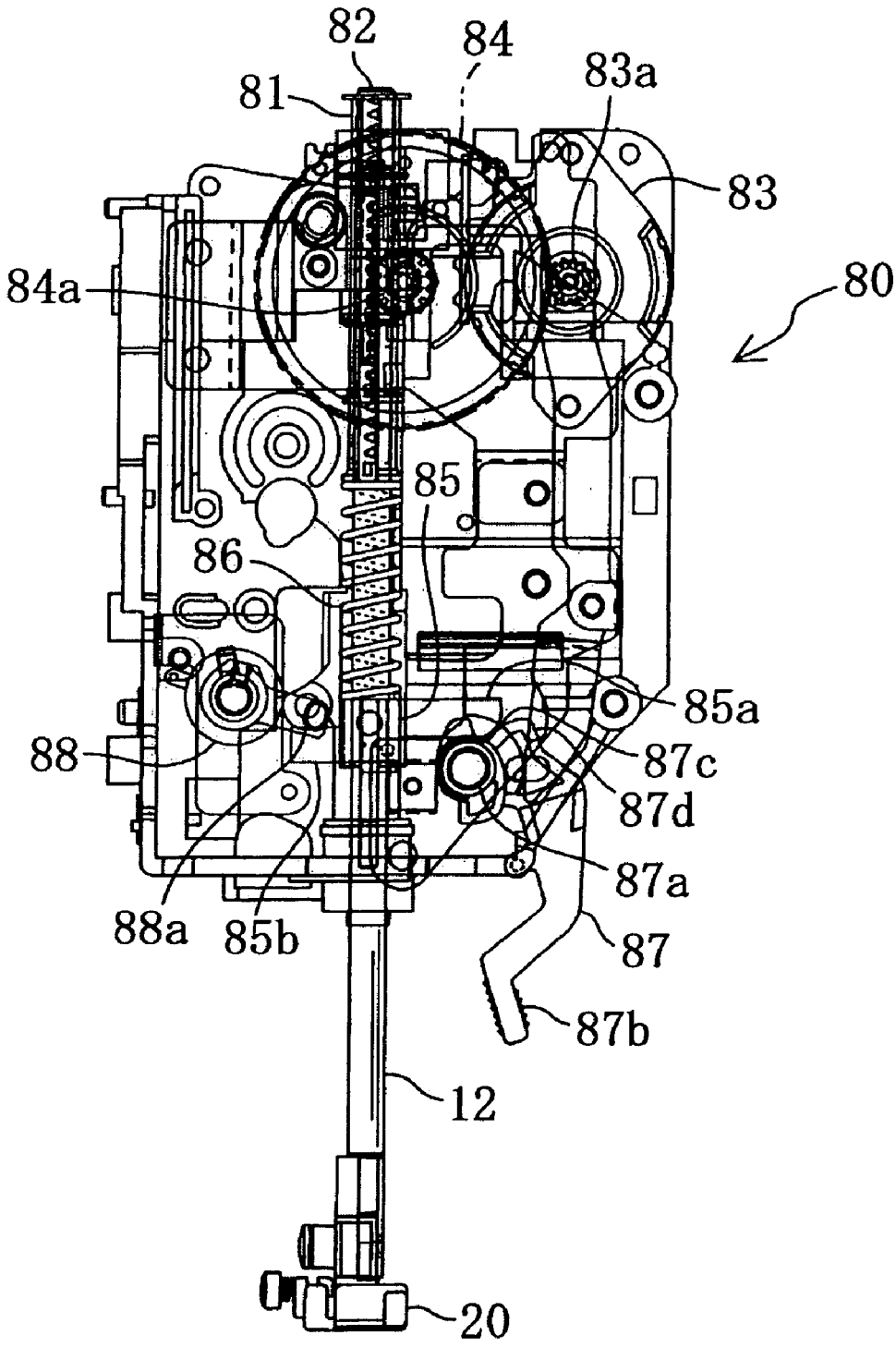
FIG. 9 is a transparent front view of a vertically moving mechanism.
Figure 10:
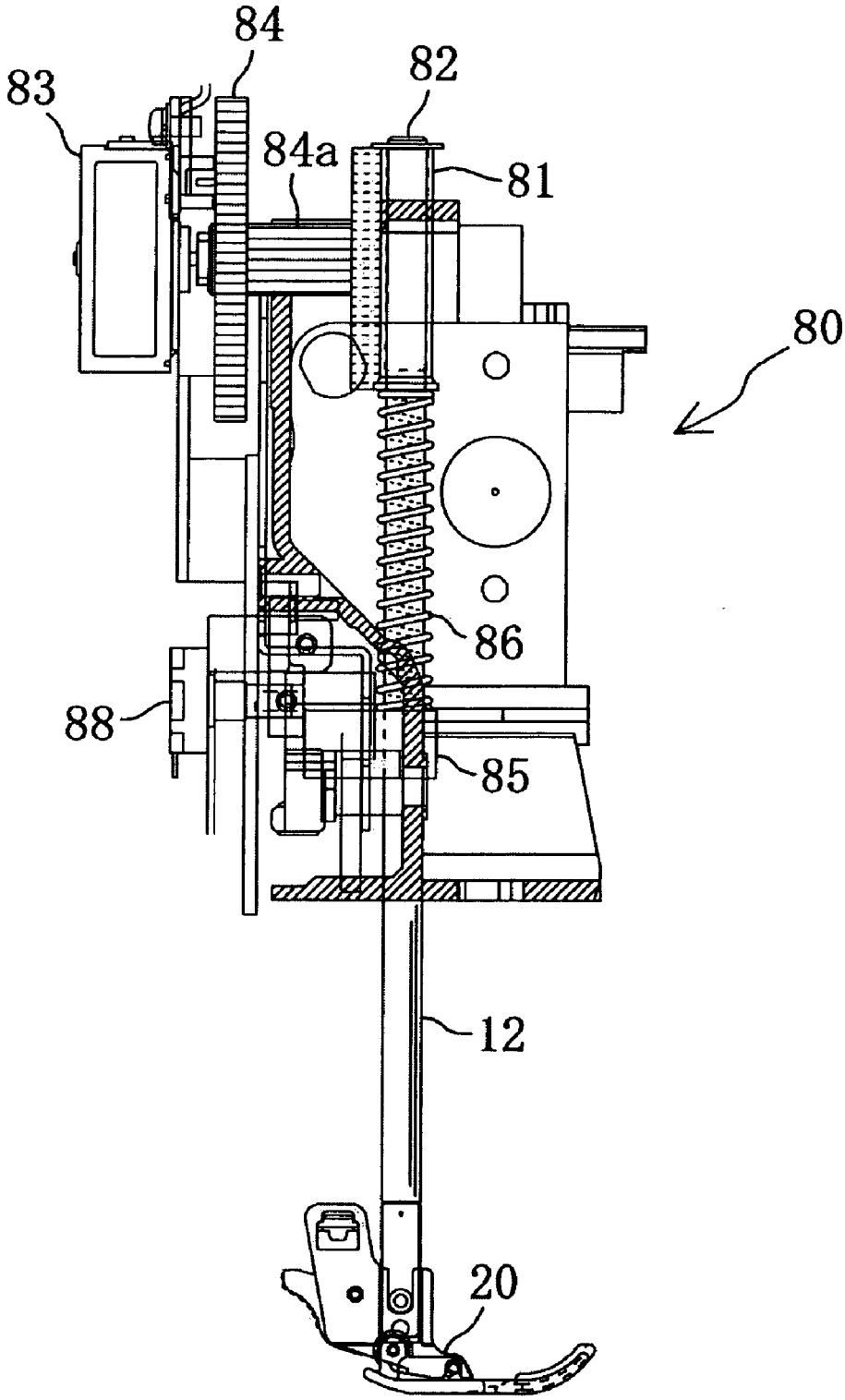
FIG. 10 is a transparent left side view of the vertically moving mechanism.
Figure 11:
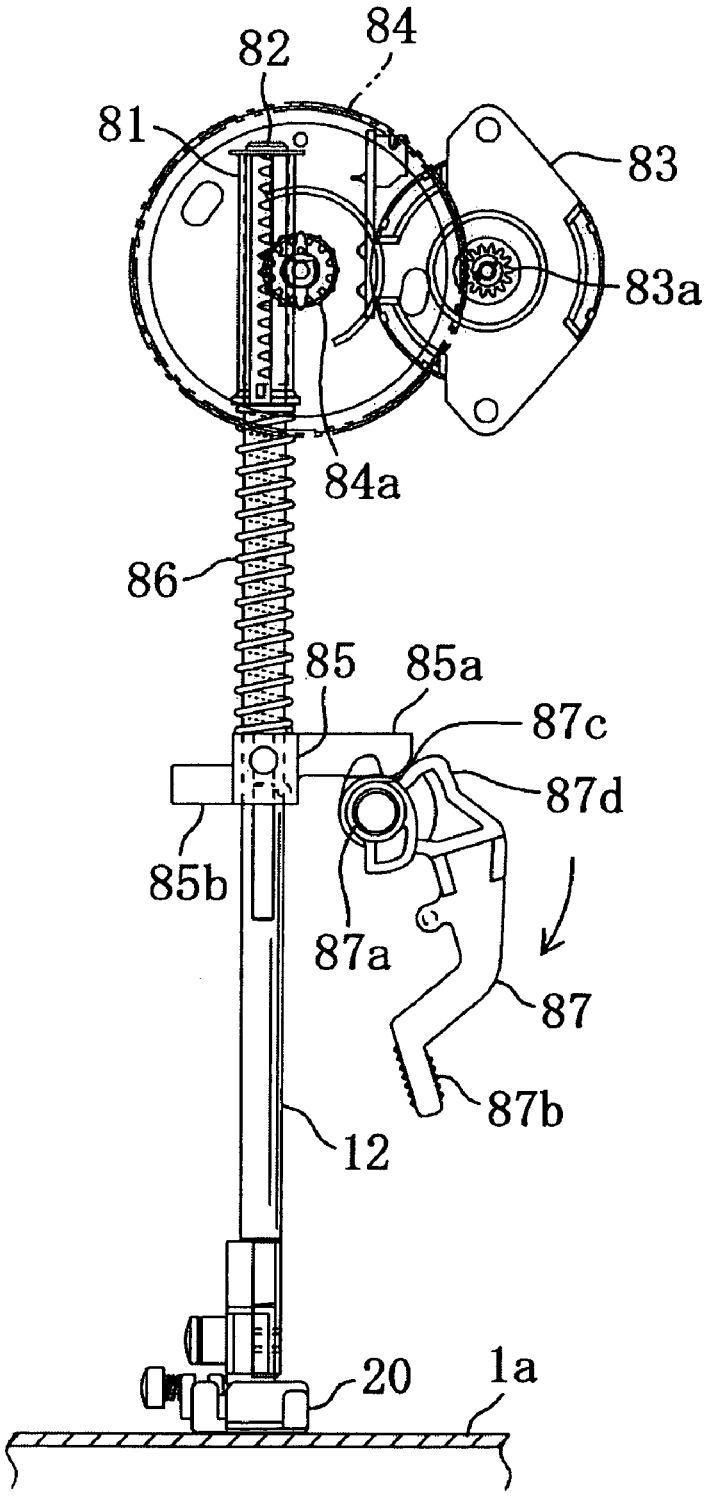
FIG. 11 is a front view showing a part of the vertically moving mechanism when a presser foot lifting lever is in a hold-down position.
Figure 12:
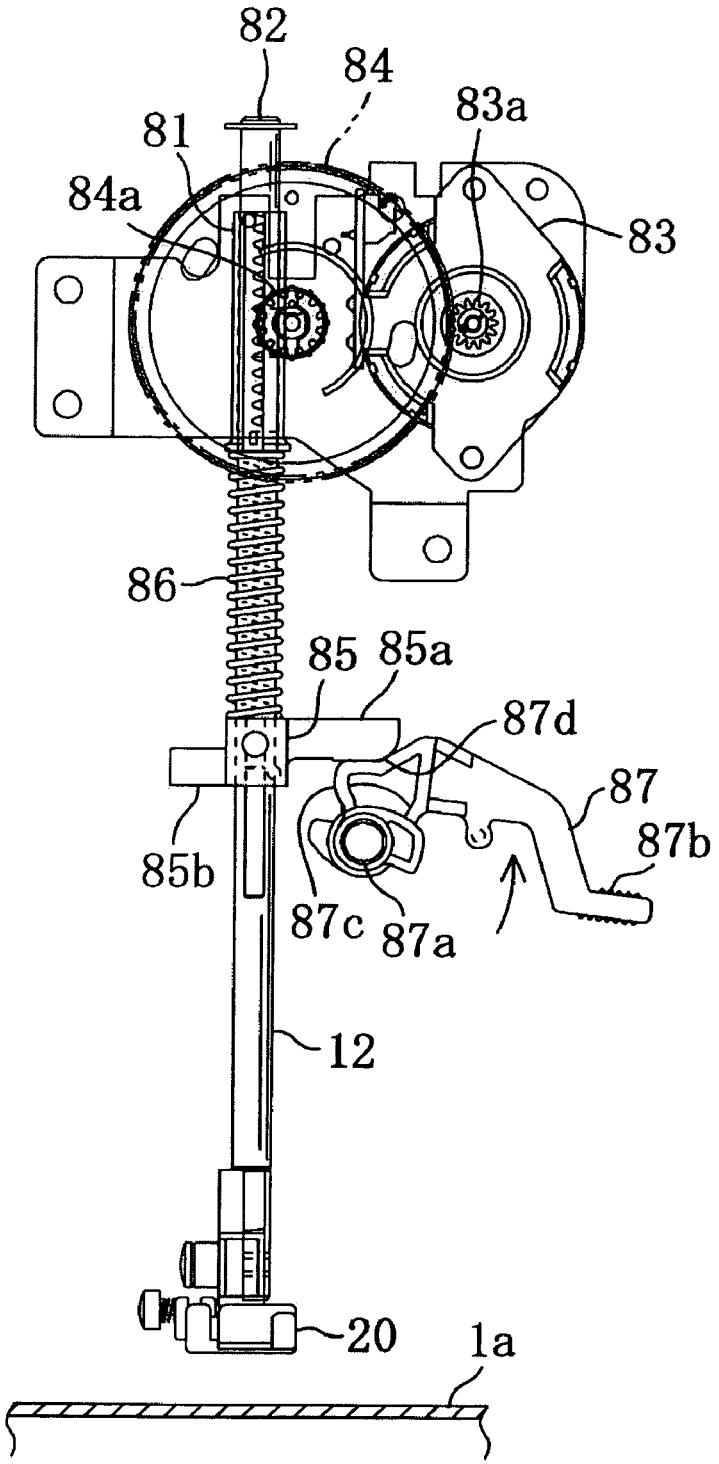
FIG. 12 is a front view showing a part of the vertically moving mechanism when the presser foot lifting lever is in a hold-up position.

The presser bar 12 is located in the rear of the needle bar 11, supported so as to be vertically movable. In a lower end of the presser bar 12, a presser foot 20 (refer to FIGS. 9 and 10) is detachably attached. The presser bar 12 is vertically moved by a vertically moving mechanism 80.

When the automatic threading start switch 25 is turned on, the automatic threading device 16 is activated while an automatic needle threading device 17 is activated in conjunction. This passes the needle thread extending from the thread spool 9 through the thread take-up lever 13, thread tension regulator 14, take-up spring 15 and threads the thread eye 19*a* of the sewing needle.

The automatic threading device 16 as shown in FIGS. 5, 6, 7A–7F is provided with a first thread transferring mechanism 50 having a first thread transferring member 51, a first thread pulse motor 53 driving the first thread transferring mechanism, a second transferring mechanism 60 having the second thread transferring member 61, the second pulse motor 66 to drive the second thread transferring mechanism 60. The first thread transferring member 51 moves and passes the needle thread 10 set on the first thread preparation path through a plurality of thread passing parts (thread tension regulator 14, thread spring 15, thread take-up lever 13 etc.). The second thread transferring member 61 transfers the needle thread to the sewing needle 19 located downstream relative to the thread take-up lever 13.

Concretely, the needle thread 10 located upstream relative to an introduction guide 41 of the thread take-up lever 13 is pulled and moved by the first thread transferring member 51 to the thread take-up spring 15, while the needle thread 10 is hooked on the thread tension regulator 14. Then, after being transferred by the first string transferring member 51, the needle thread is hooked by the thread take-up spring 15.

Also, the needle thread 10 is hooked on a thread take-up lever thread hook 40 of the thread take-up lever 13 of while it is being transferred by the first and second thread transferring members 51 and 61.

A first guide frame 52 is fixed on the sewing machine frame. A thread guiding cover 35 is mounted along the outer diameter of the first guide frame 52, from the slightly set back location of the upper part of the diameter, down to the front and onto the slightly set back location in the lower part of the diameter. The first thread transferring member 51 has a leg engaged on the outer perimeter of the first guide frame 52 and in between the leg and the first guide frame, the thread guiding cover 35 is sandwiched. Such configuration movably supports the first transferring member 51 on the outer perimeter of the guide frame 52. The first transferring member 51 is configured to move along the vertical extent from the upper, front and the lower part of the diameter. The upper part of the outer diameter of the first guide frame 52 is a stand-by position (refer to FIG. 7A) of the first thread transferring member 51 and the lower part of the first guide frame 52 is a thread turnover position (refer to FIG. 7D).

The first thread transferring member 51 has a thread hook (not shown) located near the thread guidance cover 35. The needle thread 10 hooked on the first preparation path 30 is transferred downward by being hooked on the thread hook of the first thread transferring member 51, while the first thread transferring member 51 is moved from the stand-by position to the thread turnover position. At this time, the needle thread 10 located upstream relative to the first transferring member 51 is hooked on the thread tension regulator 14. Then, when the first transferring member 51 is moved to the thread turnover position, the needle thread 10 hooked on the first thread transferring member 51 is transferred from the front to the rear side of the lower end of the first guide frame 52 and pulled by the second thread transferring member 61 to be guided into the lower end of a notch 52*a* in the lower part of the first guide frame 52 and hooked on the take-up spring 15.

The second thread transferring mechanism 60 has two or right and left guide frames 62 and 63 fixed on the sewing machine frame, a movable frame 64 movable from a retracting position (position shown in FIG. 7A) to a protruding position(position shown in FIG. 7E) supported in a guiding manner by the second guide frames 62 and 63, the second thread transferring member 61 movable between the stand-by position (position shown in FIG. 7A) and the thread turnover position (position shown in FIG. 7E), and the second drive mechanism 65 driving the movable frame 64 and the second thread transferring member 61.

The second guide frames 62 and 63 are arranged on the left side of the needle bar 12 and the thread take-up lever 13. The guide frames 62 and 63 respectively are of long vertical plate frames, and are arranged in the left and right convergingly. Between the guide frames 62 and 63 the movable frame 64 is arranged movably.

The movable frame 64 is configured by convergingly connecting a pair of thin long movable piece and the foot of the second thread transferring member 61 is inserted in between the movable pieces. Vertically extending guide grooves 62*a* and 63*a* are formed on the second guide frames 62 and 63 respectively and the movable frame 64 moves with the guidance of the guide groove 64*a*.

Figure 7A:
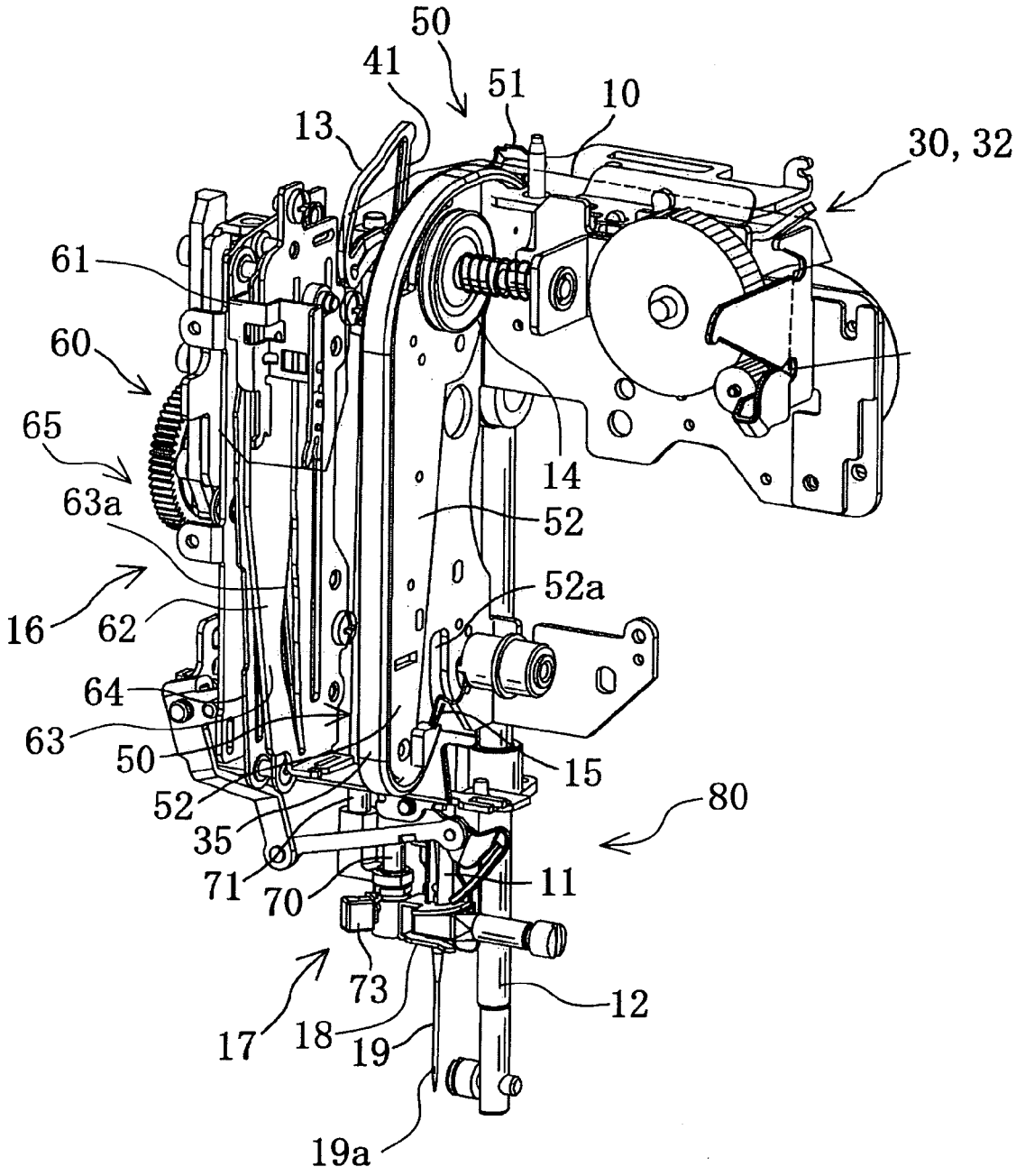
FIG. 7A is a perspective view of the automatic threading apparatus and automatic threading mechanism in a stand-by state.
Figure 7B:
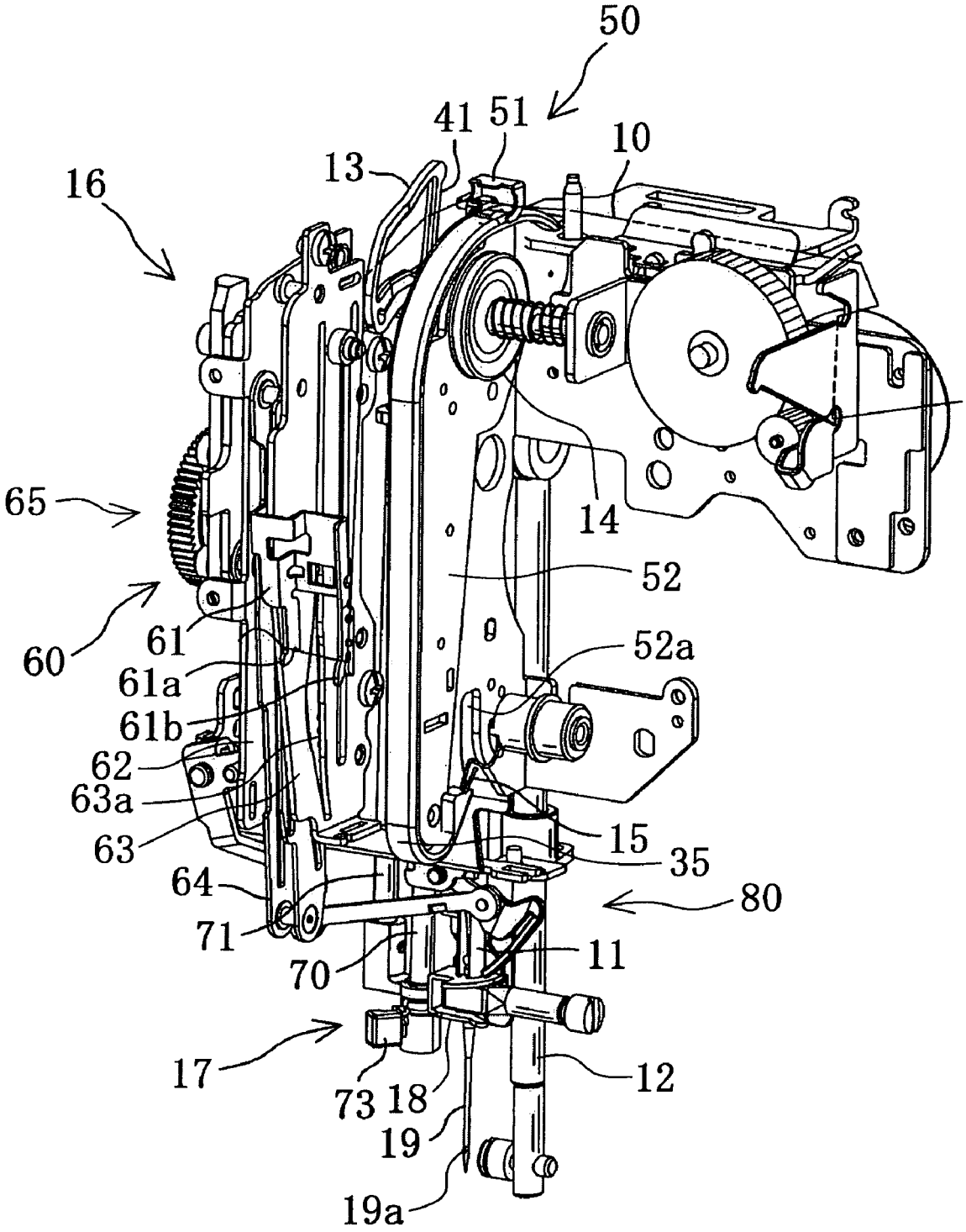
FIG. 7B is a perspective view of the automatic threading apparatus and automatic threading mechanism in a thread-hooked state.
Figure 7C:
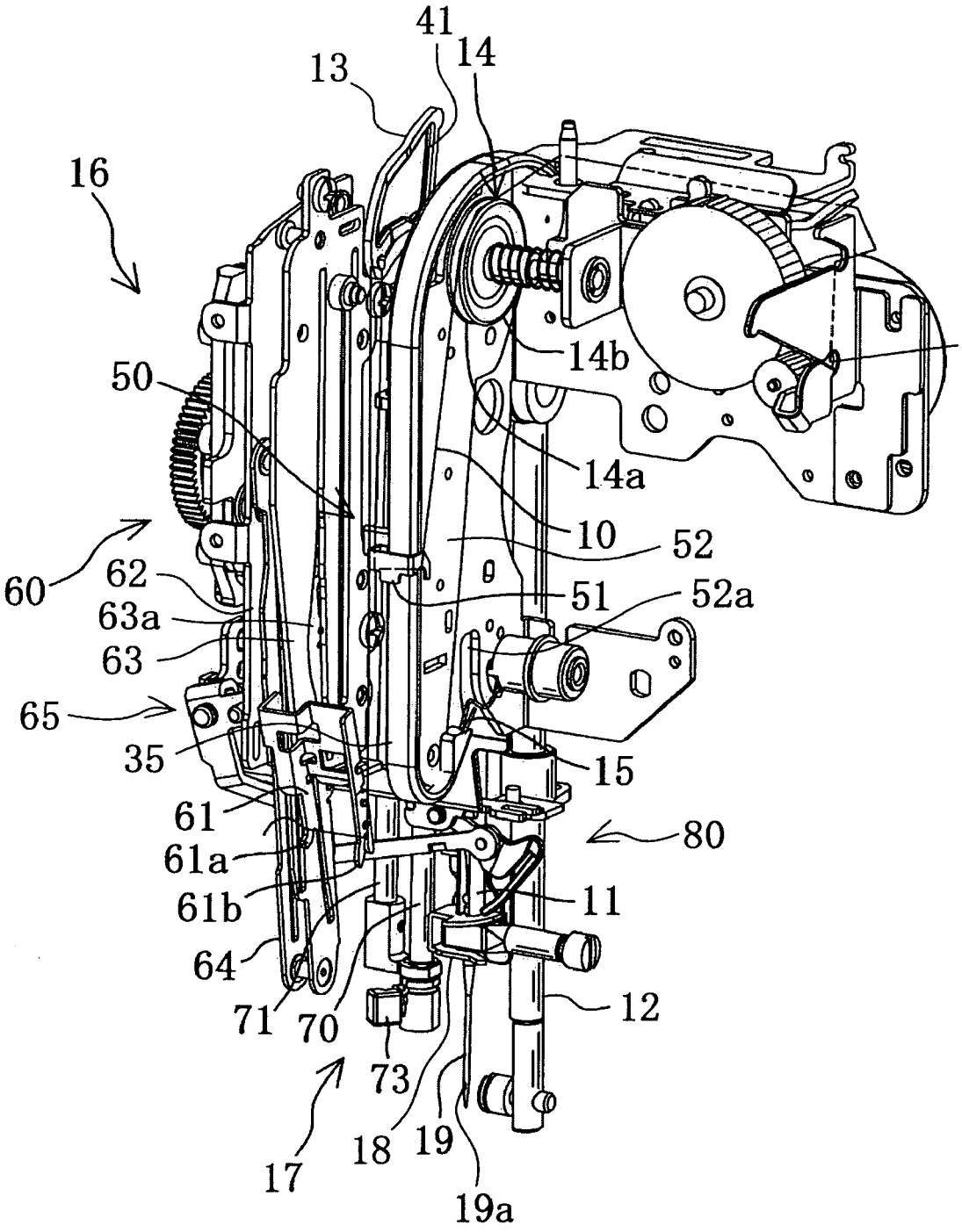
FIG. 7C is a perspective view of the automatic threading apparatus and automatic threading mechanism with a thread take-up lever in thread-hooked state.
Figure 7D:
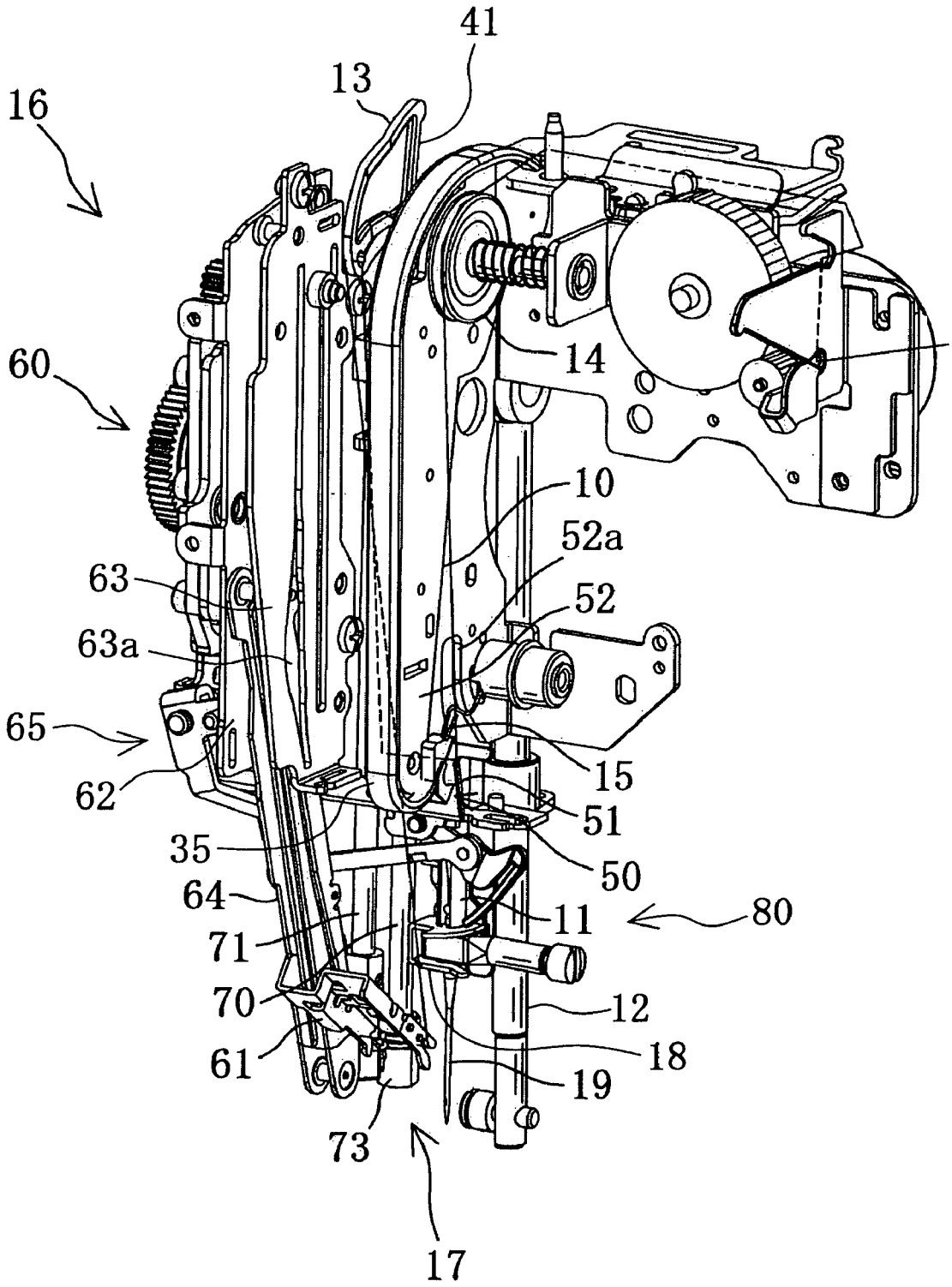
FIG. 7D is a perspective view of the automatic threading apparatus and automatic threading mechanism with a thread take-up spring in thread-hooked state.
Figure 7E:
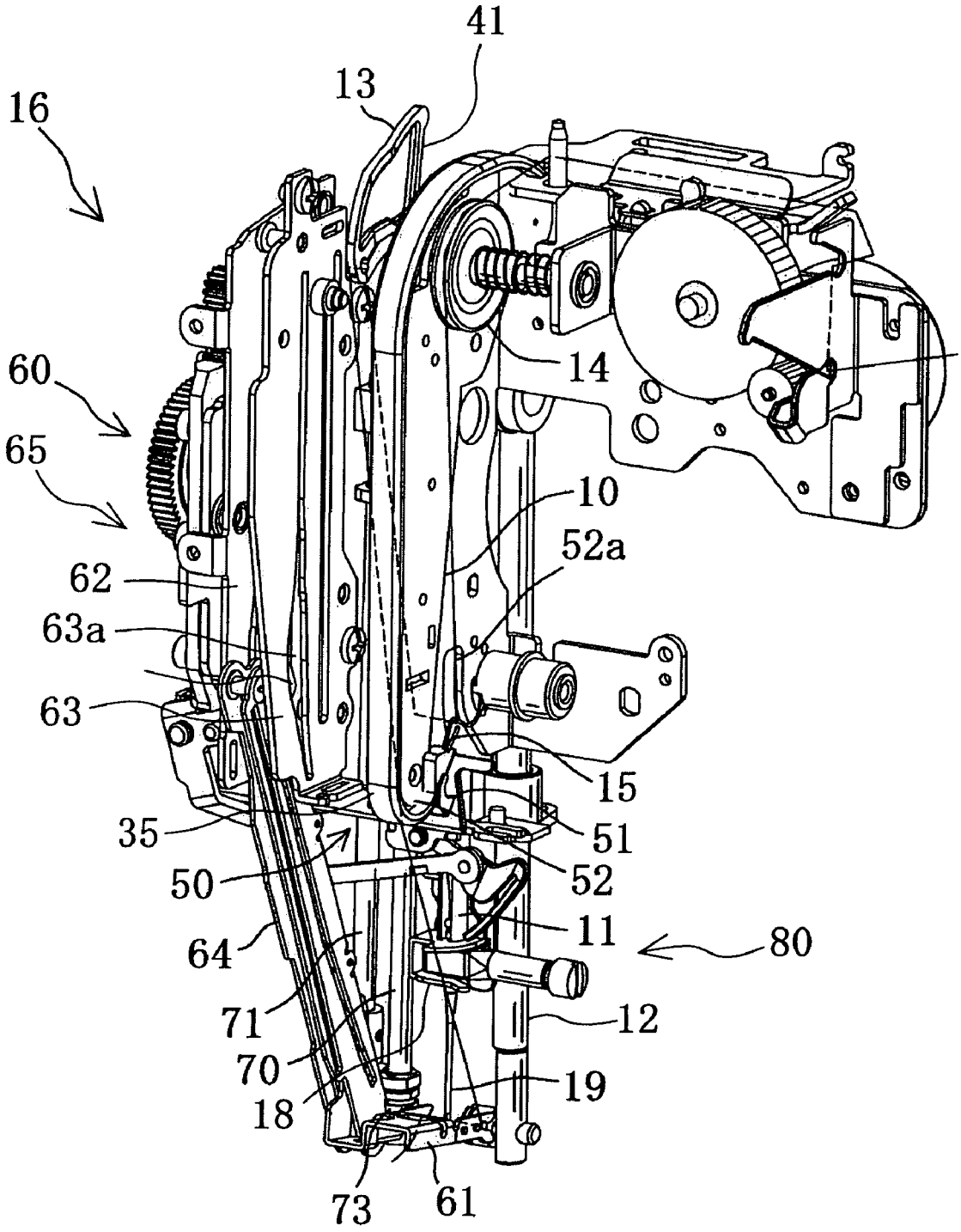
FIG. 7E is a perspective view of the automatic threading apparatus and automatic threading mechanism in a thread-transferring state.
Figure 7F:
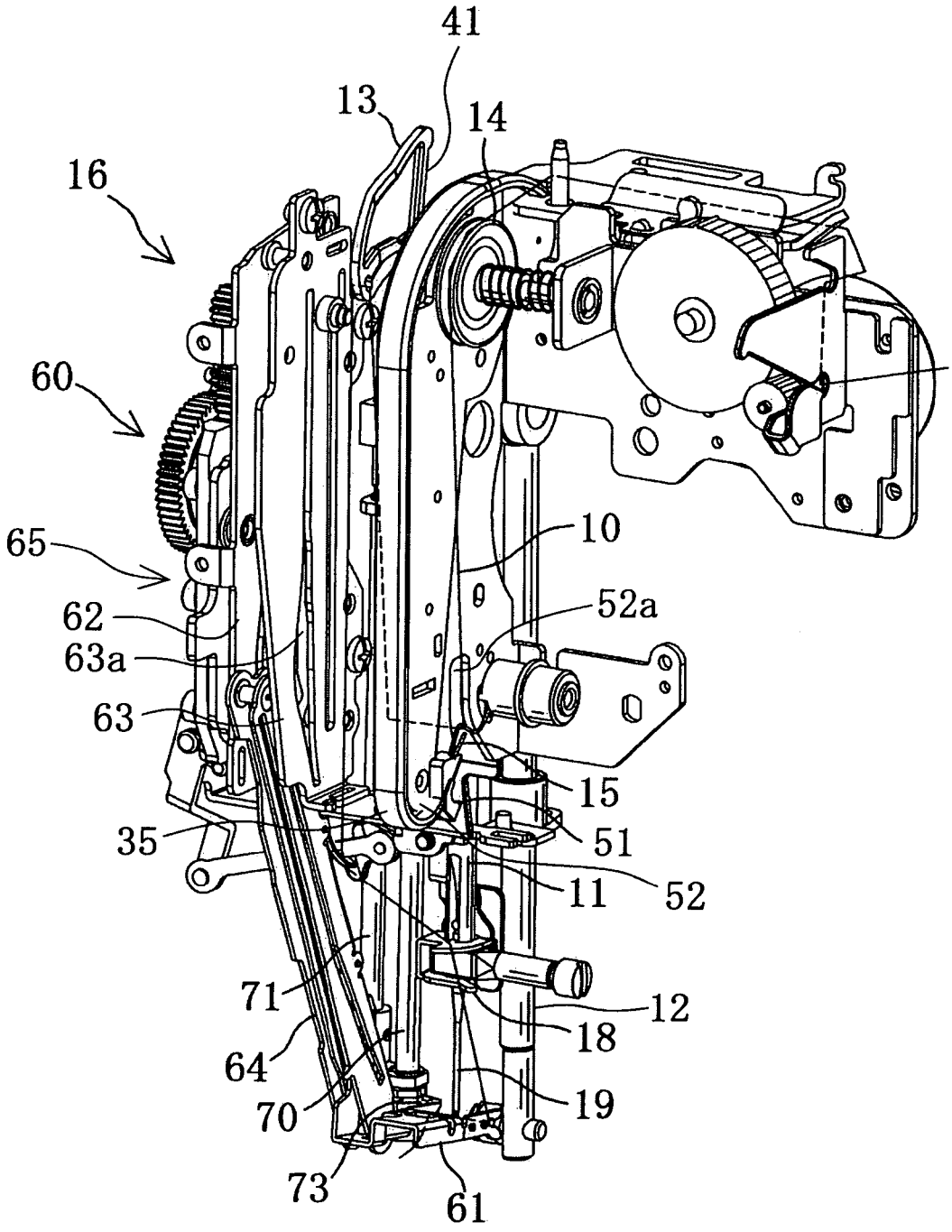
FIG. 7F is a perspective view of the automatic threading apparatus and automatic threading mechanism with a needle bar thread guide in thread-hooked state.
Figure 8A:
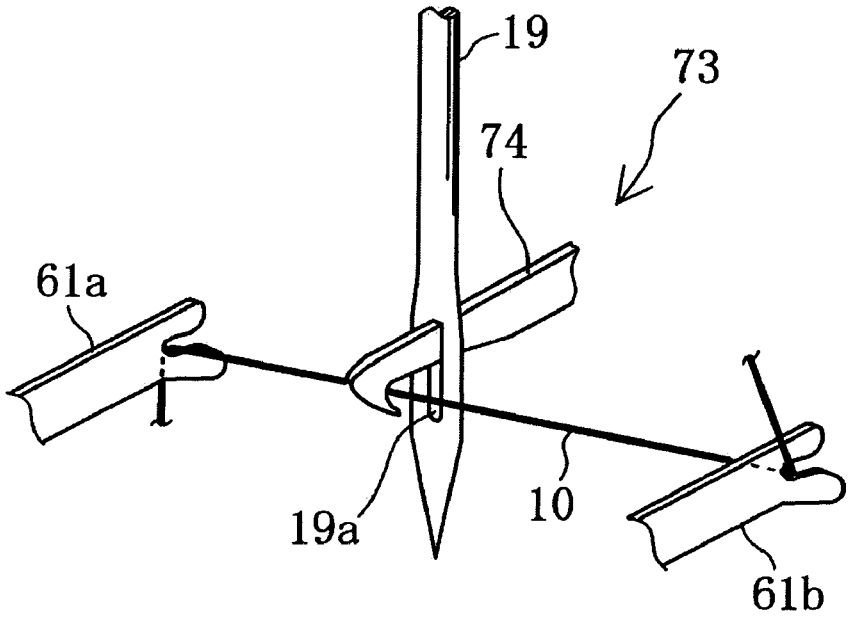
FIG. 8A is a view showing a thread hooking member coming out of a needle hole.
Figure 8B:
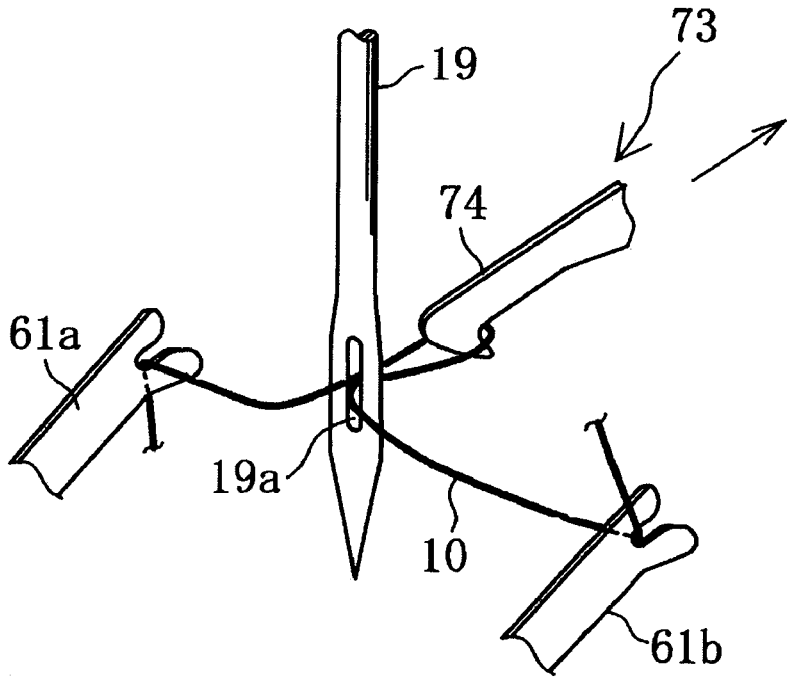
FIG. 8B is a view showing the thread hooking member coming out of the thread eye to pass the thread therethrough.

As shown in FIGS. 6 and 7A, in the stand-by position located immediately in the front and below the thread take-up lever 13, the second thread transferring member 61 is in a nearly-horizontal and rear faced disposition. On the other hand, as shown in FIG. 7E, in the thread turnover position in the front of the sewing needle 19, the second thread transferring member 61 is in a nearly-horizontal and rear faced disposition. The second thread transferring member 61 has a pair of left-right symmetrical thread retaining member 61*a* and 61*b*, capable of retaining the needle thread 10 arranged in the first thread preparation path 30. The thread retaining members 61*a* and 61*b* are in a bifurcated form and on the left side of the thread retaining member 61*a* a sandwiching piece (not shown) is mounted to releasably sandwich the needle thread 10. When the second transferring member 61 is moved from the stand-by position to the thread turnover position, the needle thread 10 hooked on the first thread preparation path 30 is retained by the thread retaining members 61*a* and 61*b* and transferred downwards. Then, when the second thread transferring member 61 is moved to the thread turnover position, the needle thread 10 retained by the thread retaining members 61*a* and 61*b* is moved to the location immediately in front of the needle eye 19*a* of the thread needle 19.

The automatic threading mechanism 17, as shown in FIGS. 5, 6, 7A to 7F, 8A and 8B, is provided with a vertically long threading shaft 70, a threading guide axis 71, a threading slider 72, a hook mechanism 73, and a threading drive mechanism(not shown) driving the threading slide 72 in a vertically moving manner. The threading shaft 70 is arranged immediately to the left of the needle bar 11 in a vertically reciprocable manner. The threading guide axis 71 is arranged immediately to the left of the threading shaft 70 and is configured to vertically move integrally with the threading shaft 70. The threading slider is inserted vertically reciprocably on the upper end of the 72 threading axis and threading guide axis 71. The hook mechanism 73 is provided in the lower end of the threading shaft 70 and has a threading hook member 74 which threads the thread eye 19*a* of the needle thread 19. The automatic threading mechanism 17 is activated in conjunction with the second thread transferring mechanism 60 of the automatic threading device 16 and co-operatively passes the needle thread 10 through the needle eye 19*a* of the sewing needle 19 with the second thread transferring mechanism 60. Concretely, as the second thread transferring member 61 moves to the thread turnover position, the threading shaft 70 reaches the lower limit and rotates approximately 90 degrees to introduce the thread hook member 74 into the needle eye 19*a* of the sewing needle 19. Then, when the threading hook member 74 is hooked(refer to FIG. 8A) on the needle thread 10 held by the thread retaining member 61*a* and 61*b*, the thread retaining shaft 70 rotates 90 degrees in the reverse direction and the thread hook member 74 comes out of the needle eye 19*a* of the sewing needle 19. As a result, the needle thread 10 is passed through the thread eye 19*a* of the sewing needle 19 and the threading axis etc. elevates to return to its original position.

Next, the vertically moving mechanism 80 is explained with reference to FIGS. 9–12. On the outer diameter of the upper end of the presser bar 12, a rack-forming member 81 is attached vertically reciprocably. Also, on the upper end of the presser bar 12, a stop ring 82 is fixed. On the immediate right of the rack form member 81, a presser foot moving pulse motor 83 (corresponding to a drive mechanism) to vertically move the presser bar 12 is fixed on the sewing machine frame. On the output axis of the motor 83 a drive gear 83*a* is connected and an intermediate gear 84 is engaged to the drive gear 83*a*. In the intermediate gear 84, a pinion 84*a* engaging the rack-forming member 81 is integrally formed. In the upright middle of the presser bar 12 a presser bar clamp 85 is fixed, through which a presser spring 86 is inserted. A presser foot lifting lever 87 (corresponding to a manual operation member) vertically moving the presser bar 12 is provided to the right of the presser bar 12. The presser foot lifting lever 87 is independent from the vertical movement of the presser bar 12 driven by the presser foot moving pulse motor 83. A coil spring (not shown) energized in the clockwise direction is provided on the presser foot lifting lever 87. Also, a potentiometer 88 is provided to the immediately left of the presser bar 12.

The vertically moving mechanism 80 is configured by the presser bar 12, the rack-forming member 81, the pulse motor 83, the drive gear 83*a*, the intermediate gear 84, pinion 84*a*, the presser spring 86, and the potentiometer 88 etc. A limit switch 89 (shown only in FIG. 16) is provided near the presser foot lifting lever 87. The limit switch 89 is turned on and off in conjunction with the operational location of the presser foot lifting lever 87. For example, in case the range of vertical movement of the presser bar 12 is 14 mm, when the presser foot lifting lever 87 is positioned in an operational location such that it lifts the presser bar 12 more than 7 mm from the lowest position, the limit switch 89 is turned on and when it is elevated 7 mm or less, the limit switch 89 is turned off. Therefore, the limit switch 89 corresponds to a presser foot lifting lever position detector which detects the operational position of the presser foot lifting lever 87.

The potentiometer 88 is a rotating potentiometer and corresponds to a presser foot lifting lever position detector which detects the operational position of the presser bar 12. The potentiometer 88 has an axis 88*a* extending to the right from the rotational axis. The axis 88*a* contacts the upper surface of a protrusion 85*b* projecting to the left of a presser bar clamp 85 and the axis 88*a* rotates in response to the vertical movement of the presser bar clamp 85 and changes the resistance of the potentiometer 88. A control device C (shown only in FIG. 16) detects the presser bar 12 based on the voltage corresponding to the resistance of the potentiometer 88.

Also, one end of the presser foot lifting lever 87 has a boss surface 87*c* and a cam surface 87*d*. In the lowered position shown in FIG. 11, the boss surface 87*c* of the presser foot lifting lever 87 is slightly vertically spaced apart from a cam follower 85*a* integrally provided with the presser bar clamp 85 and the presser foot 20 is earthed to the needle plate 1*a*. On the other hand, in the elevated position shown in FIG. 12, the cam surface 87*d* of the presser foot lifting lever 87 contacts the cam follower 85*a* and the presser bar 12 is in the elevated position. At this time, the presser foot moving pulse motor 83 is magnetized in a non-rotating state and the vertical position of the rack form member 81 is maintained. Therefore, the presser spring 86 is compressed, the elasticity of which presses the cam follower 85*a* to the cam surface 87*d*. Also, the cam follower 85*a* presses the presser foot lifting lever 87 counter-clockwise and therefore, the presser foot lifting lever 87 is locked at that position.

Figure 13:
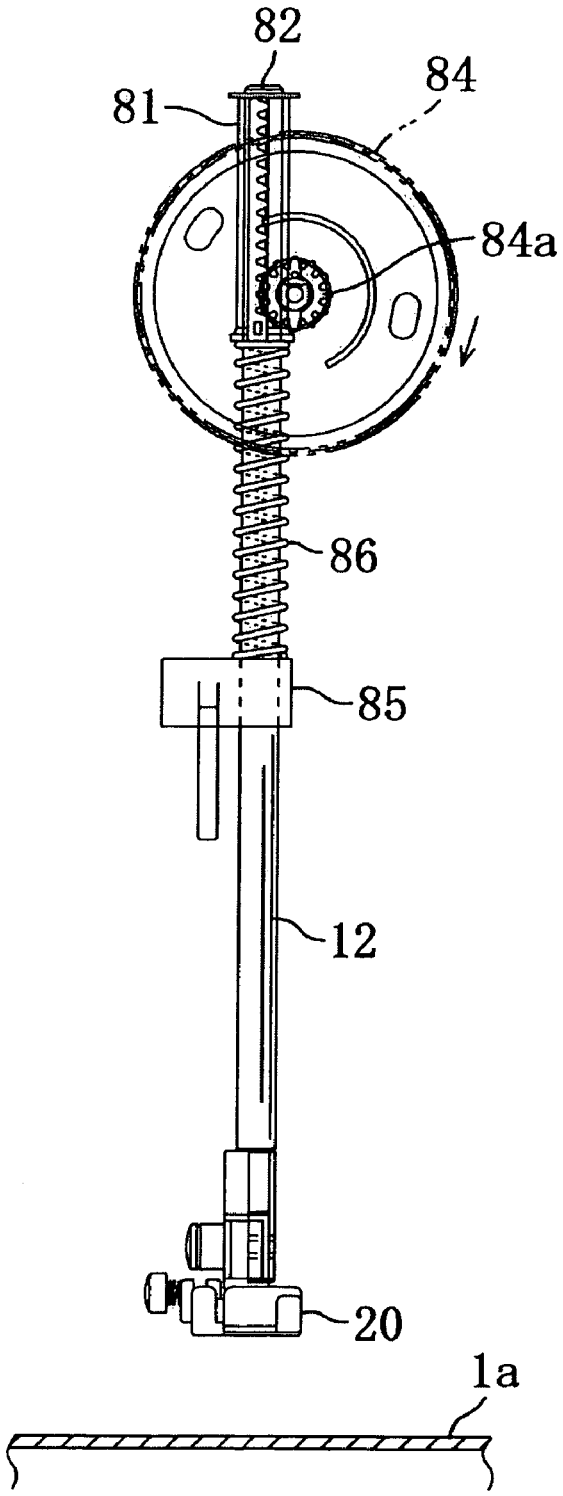
FIG. 13 is a front view showing a part of the vertically moving mechanism, in which the presser bar is in an engagement cancel position.
Figure 14:
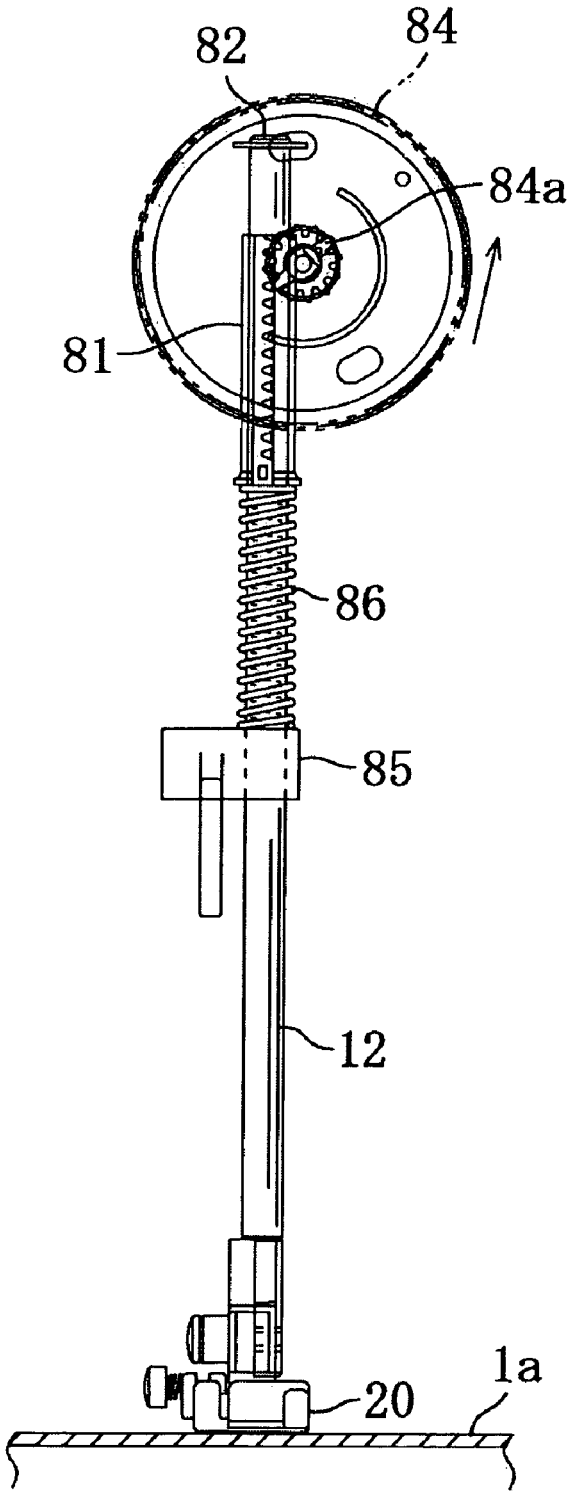
FIG. 14 is a front view showing a part of the vertically moving mechanism, in which the presser bar is in the lowest position.

Now, the vertical movement of the presser bar 12 with drive of the presser foot moving pulse motor 83 is explained with reference to FIGS. 13-15. When the presser foot moving pulse motor 83 is driven, the drive power is transmitted to the intermediate gear 84, pinion 84*a* and vertically moves the rack form member 81. As shown in FIG. 13, when the rack-forming member 81 is elevated and its upper end contacts the stop ring 82 fixed on the upper end of the presser bar 12, presser bar 12 along with the rack-forming member 81 is elevated and consequently, the presser foot 20 is elevated. The elevated position of the presser foot 20 in FIG. 13 is higher than that of FIG. 12 and the elevated position in FIG. 13 hereinafter is considered to be the most elevated position.

When the rack-forming member 81 is lowered from the most elevated position shown in FIG. 13 by the presser foot moving pulse motor 83, the presser spring 86 is compressed downward by the lower end of the rack-forming member 81. Because of this, as shown in FIG. 14, presser bar clamp 85 affixed to the presser bar 12 is compressed downward and the presser foot 20 is disposed in the lowest position contacting the needle plate 1*a*.

Also, the operation of moving the presser foot 20, manually moved to the elevated position, to the lowest position is as follows. That is, the rack-forming member 81 is elevated to the highest elevated position as shown in FIG. 13 from the vertical position shown in FIG. 12 by driving the presser foot moving pulse motor 83. Then, because the cam follower 85*a* and the cam surface 87*d* of the presser foot lifting lever 87 are spaced apart, the presser foot lifting lever 87 is energized clockwise by the coil spring and lowered to the lowered position shown in FIG. 11. After that, by lowering the rack-forming member 81, the presser foot 20 is located in the lowest position.

Figure 15:
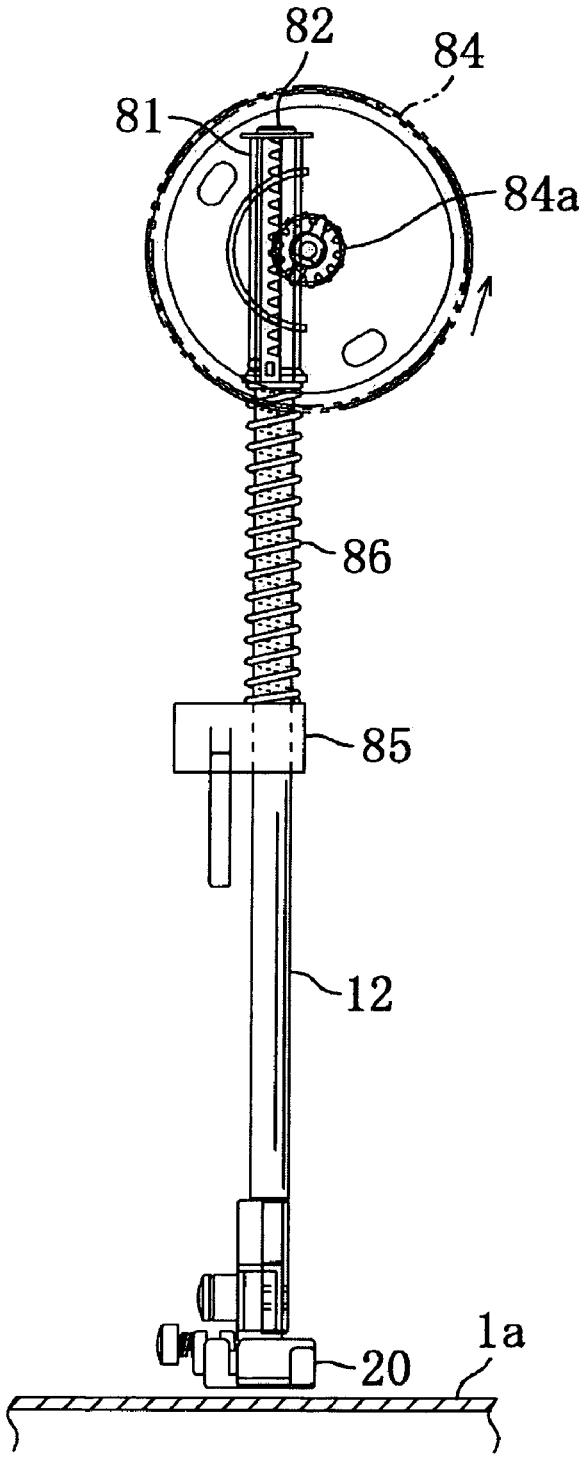
FIG. 15 is a front view showing a part of the vertically moving mechanism, in which the presser bar is in an intermediate position.

Furthermore, the operation to move the presser bar 12 to the intermediate position shown in FIG. 15 is as follows. An intermediate position is the position in between the elevated position and lowest position, in which the presser foot 20 contacts process cloth but does not suppress it so that the embroidery frame can move while embroidery sewing is performed. The intermediary position of the presser foot 12 is preset in the RAM 95 (refer to FIG. 16) depending upon the thickness of process cloth. The control device C moves the presser bar 12 by driving the presser foot moving pulse motor 83 and stops the presser foot moving pulse motor 83 when the presser bar 12 reaches the preset intermediate position.

Figure 16:
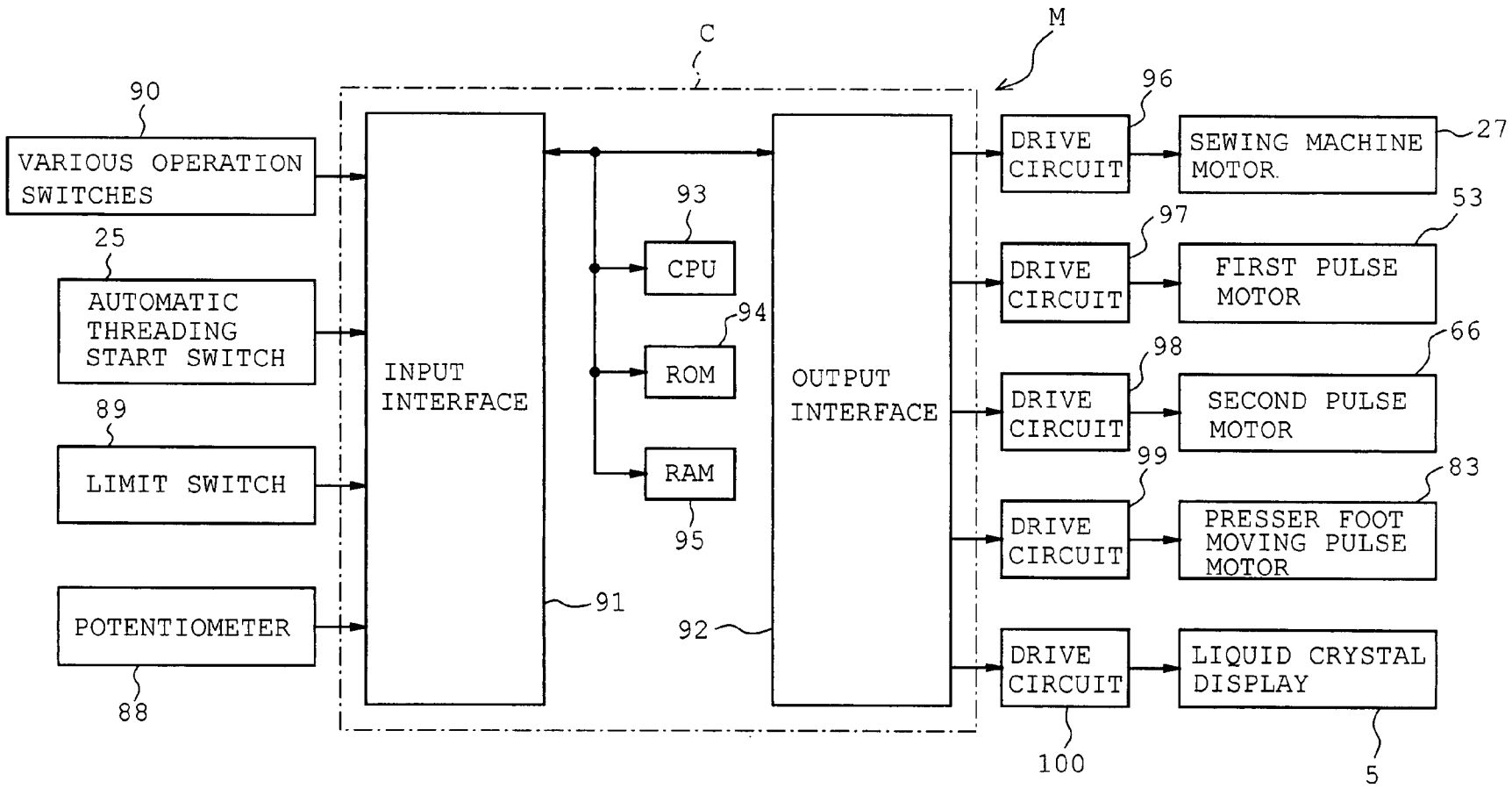
FIG. 16 is a block diagram showing a controlling portion of the sewing machine.

FIG. 16 shows the control units of the sewing machine M. The control device C of the sewing machine M has a microcomputer including a CPU93, a ROM94, a RAM95, an input interface 91 and an output interface 92. To the input interface 91 are electronically connected an operation switches 90, the automatic thread hook start switch 25, the limit switch 89, and the potentiometer 88. To the output interface 92 are electronically connected a sewing machine motor 27, the first pulse motor 53, the second pulse motor 66, the presser foot moving pulse motor 83, the liquid crystal display 5 are electronically connected via the drive circuits 96–100.

The ROM 94 stores the control program to control sewing machine M, for example, an embroidery control program, thread hooking control program to automatically hook the thread, drive mechanism control program to control the presser foot moving pulse motor 83 and display control program to display various information to the liquid crystal display 5. In the present embodiment, the CPU 93 and the drive mechanism control program corresponds to a decision means to decide whether the presser foot 20 is in a position to interfere with the thread hook member 74 and thread retaining members 61*a* and 61*b* based on the elevated position of the presser bar 12 detected by the potentiometer 88, while it also corresponds to the drive mechanism control unit controlling the presser foot moving pulse motor 83 to vertically move the presser bar 12 to the position to avoid the interference.

Also, when the automatic hook start switch 25 is operated in a state, in which the presser foot lifting lever 87 is locked in the hold-up position and the presser bar 12 is positioned in the elevated position, the drive mechanism control unit performs the following: release of the engagement between the presser foot lifting lever 87 and the cam follower 85*a* based on the position information detected by the limit switch 89; and rotation of the presser foot lifting lever 87 to displace the operation part 87*b* into the hold-down position while controlling the presser foot moving pulse motor 83 so as to move the presser bar to the lowest position.

In the RAM 95, various work memory is provided and the intermediary position information for each thickness of work cloth is stored. In case the intermediary position of the presser bar 12 is set, after completing the needle threading by the automatic threading mechanism 17, the presser bar 12 is moved to the intermediary position based on the position information stored in RAM 95.

Figure 17:
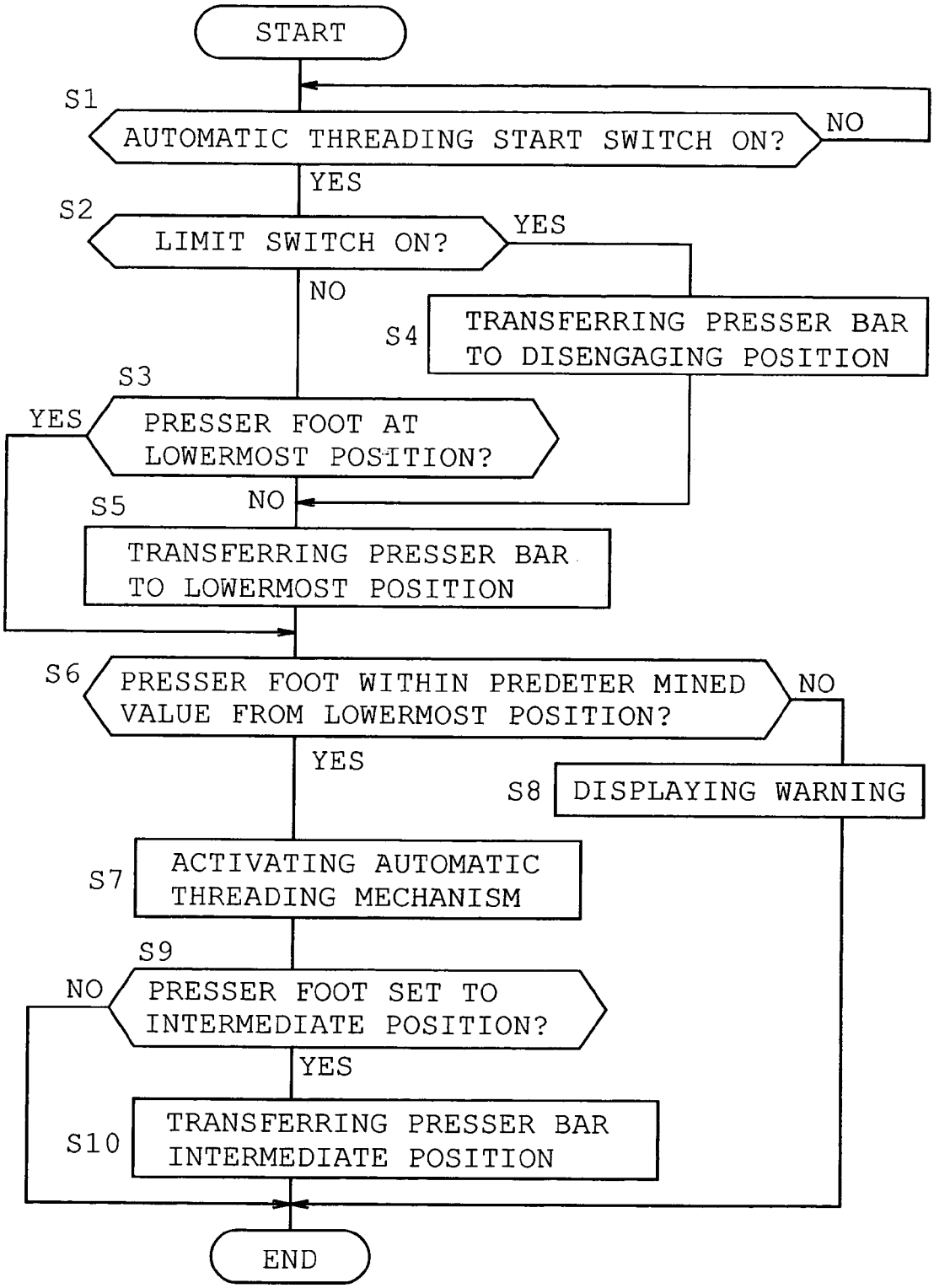
FIG. 17 is a flow chart of a threading control program.
Figure 18A:
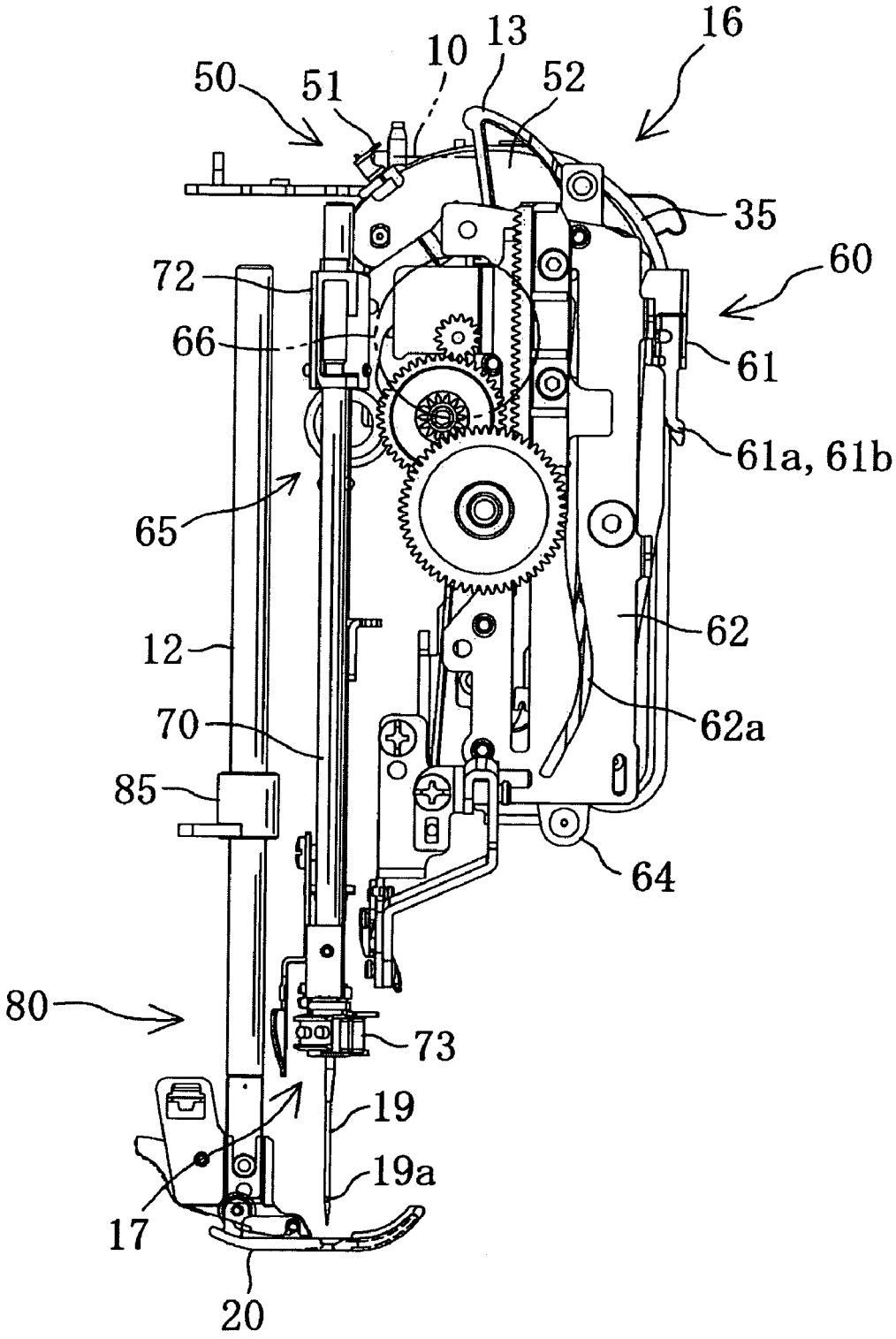
FIG. 18A is a side view of the automatic threading apparatus, automatic threading mechanism and the vertically moving mechanism when the presser bar is in the elevated position.
Figure 18B:
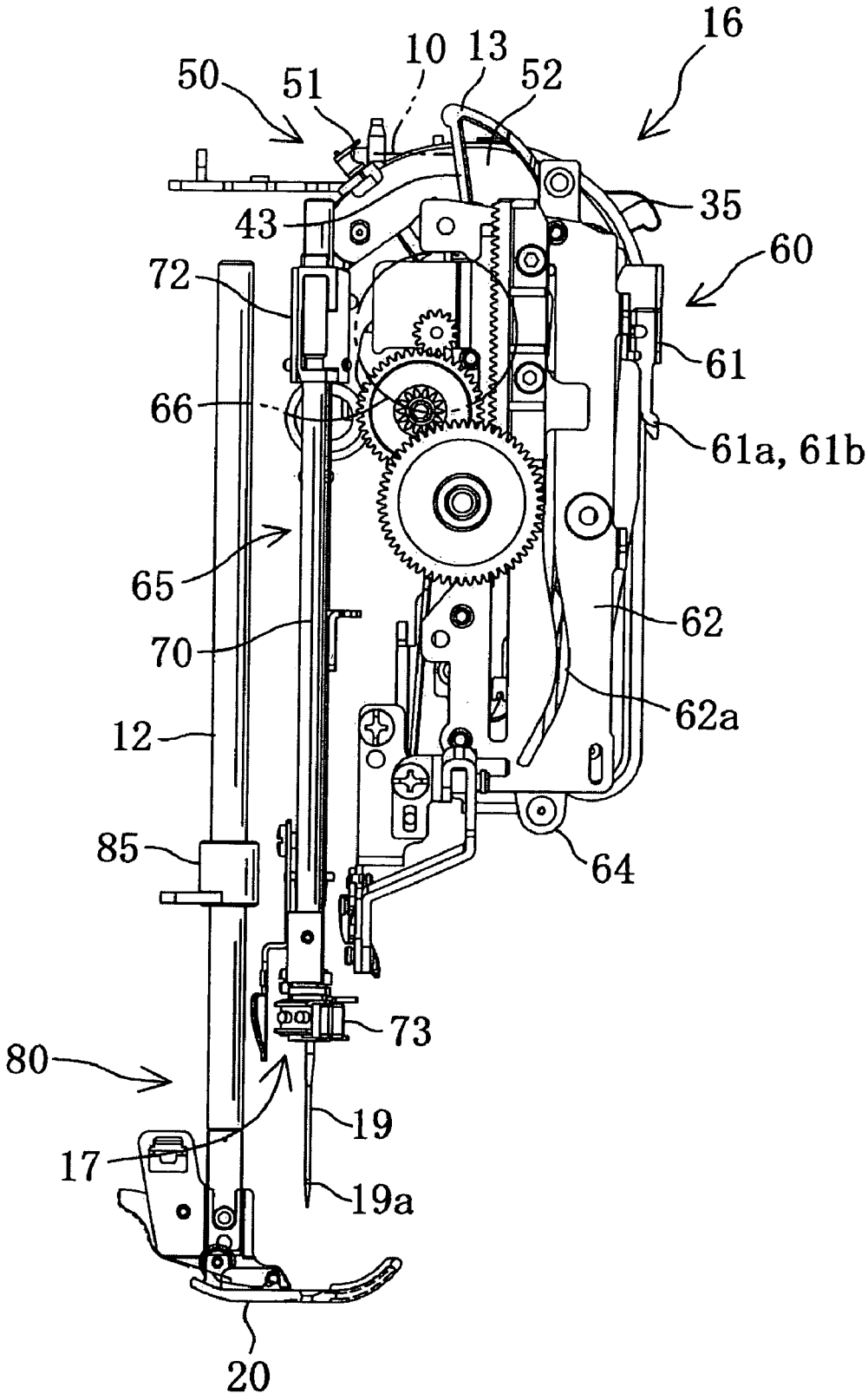
FIG. 18B is a side view of the automatic threading apparatus, automatic threading mechanism and the vertically moving mechanism when the presser bar is in the lowered position.

Next, the threading control program, in which the control device C is executed, is explained with reference to the flow chart of FIG. 17. Now, the Si(i=1, 2, 3 . . . ) indicates each step. First, the operator turns on an automatic thread hook preparation switch 23 and sets the needle thread 10 extending from the thread spool 9 in the thread preparation path. In this state, when the automatic thread hook start switch 25 is turned on (S1: YES), the operation position of the presser foot lifting lever 87 is determined (S2) based on the location position of the limit switch 89. Then, in case a position of the presser foot lifting lever 87 is in the hold-down position and the limit switch 89 is OFF (S2: NO), whether the position of the presser bar 12 in the lowest position or not is further determined (S3) by the position information of the potentiometer 88. Then, as shown in FIG. 18A, in case the position of the presser bar 12 is determined not to be in the lowest position (S3: No), the presser foot 20 is considered to be in the position interfering with the threading hook member 74 and thread retaining members 61*a* and 61*b*. At this point, the presser foot moving pulse motor 83 is driven and the presser bar 12 is moved (S5) to the lowest position (refer to FIG. 18B), in which the presser foot 20, threading hook member 74 and thread retaining members 61*a* and 61*b* are spaced apart from one another in the predetermined distance. On the other hand, when the presser bar 12 is determined to be in the lowest position (S3: Yes), the presser foot 20 is not considered to be in the position interfering with the threading hook member 74 and thread retaining members 61*a* and 61*b* and the presser foot moving pulse motor 83 is not driven.

Also, in case the position of the presser foot lifting lever 87 is locked in the hold-up position, that is, in case the limit switch 89 is ON (S2: Yes), the presser foot moving pulse motor 83 is driven, the presser bar 12 is moved to the unlock position (S4). Because of this, the lock of the second cam surface 87*d* of the presser foot lifting lever 87 and the cam follower 85*a* of the presser bar clamp 85 is unlocked; the presser foot lifting lever 87 is moved to the hold-down position by the elastic power of the coil spring. After that, the presser bar 12 is switched to the lowest position by the above given S5 process.

The presser bar 12 moved to the lowest position by the presser foot moving pulse motor 83, is actually moved from the lowest position as much as the thickness of cloth located under the presser foot 20. Therefore in S6, the moved position(a thickness of work cloth) of the presser foot 20 against the lowest position is detected by the potentiometer 88 and in case the cloth thickness is the predetermined value for example, 6 mm or less (S6: Yes), the automatic threading mechanism 17 is activated (S7). Concretely, the first thread transferring mechanism 50 is driven by the first pulse motor 53 and the needle thread 10 set on the first preparation path 30, transferred and hooked on multiple thread hook parts including the thread take-up lever (thread tension regulator 14, thread take-up spring 15, thread take-up lever 13 etc.) Also, the second transferring mechanism 60 is driven by the second pulse motor 66 and the needle thread located downstream relative to the thread take-up lever 13 is transferred towards the sewing needle 19. At this time, in synchronization with the descent of the second thread transferring member 61, the threading shaft 70 and threading guide 71 are integrally lowered with the threading slider 72. Then, when the second thread transferring member 61 reaches the thread turnover position, the descent of the threading shaft 70 and threading guide axis 71 stops. As a result, the height of the threading hook member 74 of the hook mechanism 73 and the needle eye 19*a* of the sewing needle 19 are aligned.

Figure 18C:
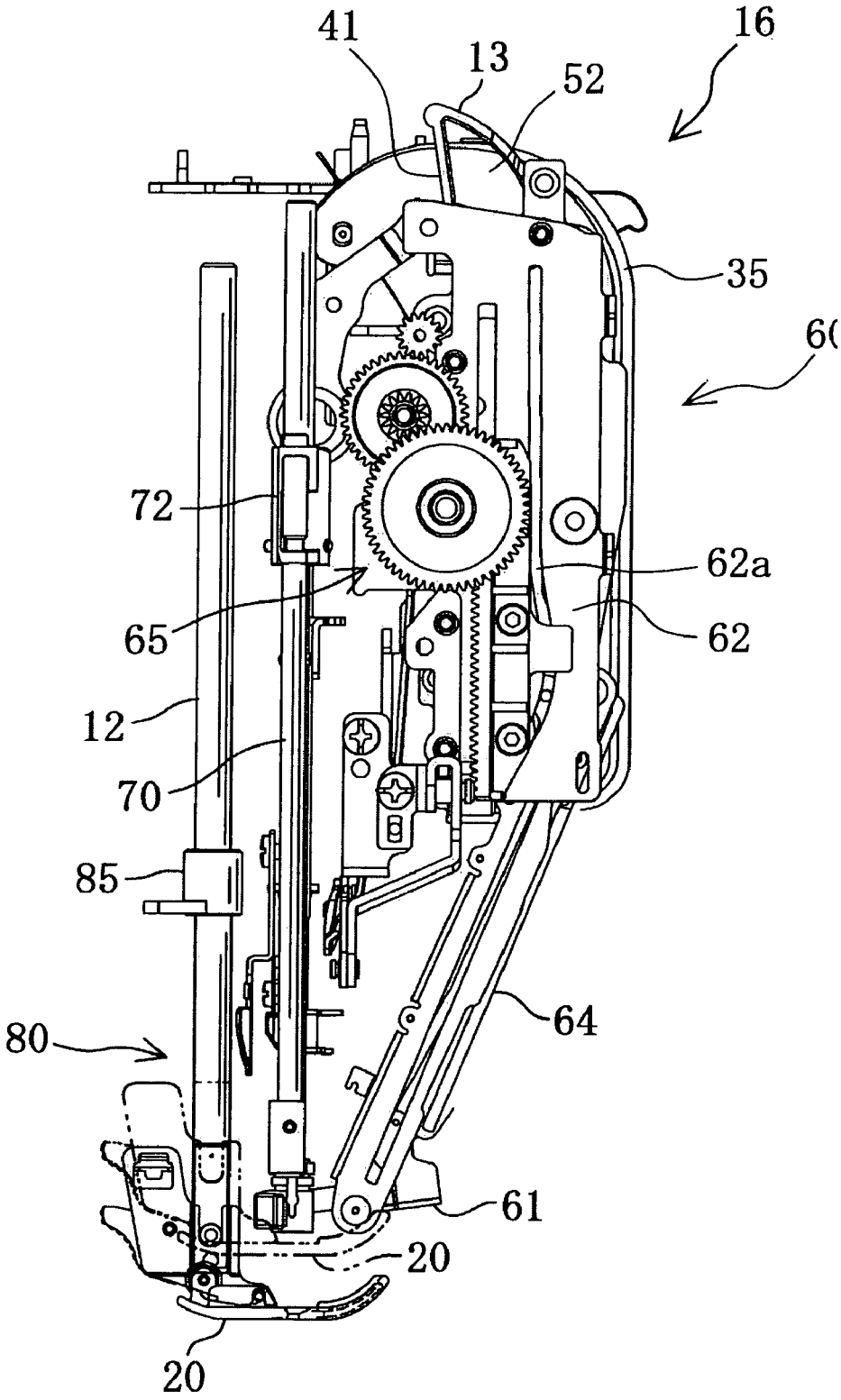
FIG. 18C is a side view of the automatic threading apparatus, automatic threading mechanism and the vertically moving mechanism in with a needle bar thread guidance in thread-hooked state.

After that, by the further descent of the threading slider 72, the threading hook member 74 is rotated about the vertical axis by the rotating mechanism. Because of this, the threading hook member 74 is introduced into the thread eye 19*a* of the sewing needle 19 and hooks and threads the needle thread 10 retained on the second thread transferring member 61 (refer to FIG. 18C) Now, in FIG. 18C, the presser bar 12 in the elevated position is indicated in double dot chained line and the lowest position in solid line. As shown in FIG. 18C, when the presser bar 12 is in the lowest position, even if the automatic threading mechanism 17 is activated, the presser foot 20, threading hook member 74 and thread retaining member 61*a*, 61*b* will not interfere.

On completion of needle threading, the control device C refers to the intermediate position information of the RAM 95. Then, in case the position of the presser bar 12 is set in the intermediate position (S9: Yes), the presser bar 12 is moved to the predetermined intermediate position (S10) by driving the presser foot moving pulse motor 83 by reading out the position information set in the RAM 95. This completes the threading control.

Also, in S6, in case the cloth thickness of process cloth is determined to be 6 mm or more (S6: No), the presser foot 20 interferes with the threading hook member 74 etc. and therefore, a warning message indicating that threading can not be performed is displayed (S8) on the liquid crystal display 5, and the activation of the automatic threading mechanism 17 is canceled.

As it is clear form the above explanation, the sewing machine M with the above configuration has the following operation and effect. When the automatic thread hook start switch 25 is operated, the position of the presser foot 20 is detected. In case the presser foot 20 is in a position to interfere with the threading hook member 74 and thread retaining members 61*a* and 61*b*, the presser foot moving pulse motor 83 of the vertically moving mechanism 80 is driven by the drive mechanism control means and the presser foot bar 20 is moved in a position, where it does not interfere with the threading hook member 74 and thread retaining members 61*a* and 61*b*.

Therefore, the needle threading process to the needle eye 19*a* of the sewing needle 19 by the automatic threading mechanism 17 can be performed smoothly. Also, because the presser foot 20 is automatically moved to a position where it does not interfere with the threading hook member 74 and thread retaining members 61*a* and 61*b*, the entire needle threading process can be performed automatically and improve the efficiency of the needle threading process.

Now, the present invention is not limited to the above given embodiment, but can be modified as follows. The position where the presser foot 20 does not interfere with the threading hook member and thread retaining member is not limited to the lowest position. That is, in case there is a non-interfering position other than the elevated position, intermediate position and lowest position, the presser bar can be transferred to such position.

The automatic thread hook device provided in the sewing machine involved in the above embodiment is configured to automatically perform both thread hook process and needle threading process, however, it can be arranged so that only the needle threading can be performed automatically. In this case, the automatic threading apparatus is configured from the second thread transferring mechanism, the second pulse motor, the automatic threading mechanism, and threading operation switch corresponding to the thread operation member. It can be configured so that, based on the operation start signal generated by the operator's ON switching of the threading operation switch, the second pulse motor and threading mechanism is driven and needle threading is performed by the second thread transferring mechanism and automatic threading mechanism.

The position detector of the presser bar elevated position is not limited to a potentiometer. Various types of displacement sensors are also applicable.

Instead of the automatic thread start switch as the threading operation unit, a thread transferring operation switch as the thread transferring operation unit can be provided. The presser foot moving pulse motor can be controlled by the drive mechanism controlling unit by moving the presser bar to the lower position, where the presser foot and the thread retaining member are spaced apart from one another in the predetermined distance as in the case, in which the automatic thread hook start switch is operated.

In this case also, as in the above embodiment, the CPU and the drive mechanism control program corresponds to the determining unit. In case the presser foot is determined to be in the position interfering with the thread retaining member by the determining unit, the second drive pulse motor is driven, and if the presser foot is determined not to be interfering with the thread retaining member, the second pulse motor is not driven.

Other forms of implementation incorporating various changes to the above embodiment are also possible and the current invention includes such forms incorporating the various changes.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a needle bar holding a sewing needle having a thread eye;

a needle threading mechanism including a threading hook for passing a needle thread through the thread eye of the sewing needle;

a presser bar having a lower end to which a presser foot is attached;

a vertically moving mechanism vertically moving the presser bar, a drive mechanism driving the vertically moving mechanism;

a needle threading operation unit operating the needle threading mechanism;

a drive mechanism controlling unit controlling the drive mechanism vertically lowering the presser bar to a position where interference between the presser foot and the threading hook is avoided when the needle threading operation unit is operated.

2. The sewing machine according to claim 1, wherein the presser foot and the threading hook are spaced apart from each other when the presser bar assumes the interference avoiding position.

3. The sewing machine according to claim 1, further comprising a thread retaining member retaining the needle thread and a thread transferring mechanism constructed to move the thread retaining member near to the thread eye of the sewing needle to transfer the needle thread near to the thread eye and further to pass the needle thread through the thread eye in co-operation with the needle threading mechanism, wherein the drive mechanism controlling unit controls the drive mechanism so that the presser bar is moved vertically to the interference avoiding position when the needle threading operation unit is operated.

4. The sewing machine according to claim 3, wherein the presser foot and the threading hook are spaced apart from each other when the presser bar assumes the interference avoiding position.

5. The sewing machine according to claim 1, wherein the presser foot is located at a lowermost position when the presser bar assumes the interference avoiding position.

6. The sewing machine according to claim 1, further comprising a presser bar position detector detecting a position of the presser bar vertically moved, wherein the drive mechanism controlling unit controls the drive mechanism based on position information detected by the presser bar position detector when the threading operation unit is operated.

7. The sewing machine according to claim 6, further comprising a determining unit which determines whether the presser foot is located at a position where the presser foot interferes with the threading hook, based on the position of the vertically moved presser bar detected by the presser foot position detector, wherein the drive mechanism controlling unit is configured not to drive the drive mechanism in a case where the determining unit determines that the presser foot assumes the interference avoiding position, when the threading operation unit has been operated.

8. The sewing machine according to claim 6, further comprising a determining unit which determines whether the presser foot is located at a position where the presser foot interferes with the threading hook, based on the position of the vertically moved presser bar detected by the position detector, wherein the drive mechanism controlling unit is configured net-to drive the drive mechanism in a case where the determining unit determines that the presser foot assumes another position than the interference avoiding position, when the threading operation unit has been operated.

9. The sewing machine according to claim 6, wherein the position detector comprises a displacement sensor.

10. The sewing machine according to claim 9, wherein the displacement sensor comprises a potentiometer.

11. The sewing machine according to claim 1, further comprising a manually operating member manually operated so that the presser bar is vertically moved, the manually operating member being independent of the drive mechanism.

12. The sewing machine according to claim 11, wherein the manually operating member has both ends and includes an operation lever pivotally supported on one of the ends of the manually operating member and having an operation portion on the other end of the manually operating member, and the operation lever is configured to be locked at an ascending rotation position at which the operation lever positions the presser bar at an ascending position.

13. The sewing machine according to claim 12, further comprising a lever position detector which detects a rotation position of the operation lever, wherein when the needle threading operation unit is operated while the operation lever is locked at the ascending rotation position, the drive mechanism controlling unit controls the drive mechanism to release the operation lever from a locked state and to rotate the operation lever so that the presser bar is moved to a lowermost position.

14. The sewing machine according to claim 13, wherein the lever position detector comprises a limit switch.

15. The sewing machine according to claim 1, wherein the needle threading operation unit includes a needle threading operation member generating a threading operation start signal starting an operation of the needle threading mechanism and a needle threading drive mechanism driving the needle threading mechanism based on the threading operation start signal.

16. The sewing machine according to claim 15, wherein the needle threading operation unit includes a thread transferring drive mechanism driving the thread transferring mechanism based on the threading operation start signal.

17. A sewing machine comprising:

a needle bar holding a sewing needle having an eye hole;

a thread retaining member retaining the needle thread;

a thread transferring mechanism constructed to move the thread retaining member from an upper position to a lower position located near the eye hole of the sewing needle for transferring the needle thread near the eye hole;

a presser bar with a presser foot attached to a lower end thereof;

a vertically moving mechanism vertically moving the presser bar, a drive mechanism driving the vertically moving mechanism;

a thread transferring operation unit operating the thread transferring mechanism; and a drive mechanism controlling unit controlling the drive mechanism so that the presser bar is vertically lowered to a position where interference between the presser foot and the thread retaining member is avoided when the thread transferring operation unit has been operated.

18. The sewing machine according to claim 17, wherein the presser foot and the thread retaining member are spaced apart from each other when the presser bar assumes the interference avoiding position.

19. The sewing machine according to claim 17, wherein the presser foot is located at a lowermost position when the presser bar assumes the interference avoiding position.

20. The sewing machine according to claim 17, further comprising a presser bar position detector detecting a position of the presser bar vertically reciprocated, wherein the drive mechanism controlling unit controls the drive mechanism based on position information detected by the presser bar position detector when the thread transferring operation unit is operated.

21. The sewing machine according to claim 20, further comprising a determining unit which determines whether the presser foot is located at a position where the presser foot interferes with the threading hook, based on the position of the vertically reciprocated presser bar detected by the presser foot position detector, wherein the drive mechanism controlling unit is configured not to drive the drive mechanism in a case where the determining unit determines that the presser foot assumes the interference avoiding position, when the thread transferring operation unit has been operated.

22. The sewing machine according to claim 20, further comprising a determining unit which determines whether the presser foot is located at a position where the presser foot interferes with the threading hook, based on the position of the vertically moved presser bar detected by the position detector, wherein the drive mechanism controlling unit is configured to drive the drive mechanism in a case where the determining unit determines that the presser foot assumes another position than the interference avoiding position, when the thread transferring operation unit has been operated.

* * * * *